US009851166B2

(12) United States Patent
Petersen

(10) Patent No.: US 9,851,166 B2
(45) Date of Patent: Dec. 26, 2017

(54) FIREARM SUPPRESSOR

(71) Applicant: DELTA P DESIGN, INC., Walterville, OR (US)

(72) Inventor: Byron Petersen, Springfield, OR (US)

(73) Assignee: DELTA P DESIGN, INC., Walterville, OR (US)

( * ) Notice: Subject to any disclaimer, the term of this patent is extended or adjusted under 35 U.S.C. 154(b) by 0 days.

(21) Appl. No.: 15/406,505

(22) Filed: Jan. 13, 2017

(65) Prior Publication Data

US 2017/0205174 A1 Jul. 20, 2017

Related U.S. Application Data

(60) Provisional application No. 62/279,555, filed on Jan. 15, 2016.

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/38
See application file for complete search history.

(56) References Cited

U.S. PATENT DOCUMENTS 955,694 A * 4/1910 Riggs ..... F41A 21/30 181/223
1,341,363 A * 5/1920 Fiala ..... F41A 21/30 181/223
1,667,186 A * 4/1928 Bluehdorn ..... F41A 21/30 181/223
1,770,471 A * 7/1930 Hatcher ..... F41A 21/30 181/223
2,609,631 A * 9/1952 Garand ..... F41A 21/04 42/76.01
2,792,760 A * 5/1957 Hammer ..... F41A 21/34 89/14.2
5,029,512 A 7/1991 Latka
8,087,338 B1 1/2012 Hines
8,104,570 B2 1/2012 Miller et al.
8,424,635 B1 4/2013 Klawunn
8,579,075 B2 11/2013 Brittingham et al.
8,910,745 B2 12/2014 Latka
8,991,551 B2 3/2015 Latka
8,991,552 B2 3/2015 Latka
9,102,010 B2 8/2015 Wilson
2015/0308776 A1* 10/2015 Smith ..... F41A 21/34 89/14.2
2016/0054087 A1* 2/2016 Palu ..... F41A 21/34 89/14.2

FOREIGN PATENT DOCUMENTS

WO 2014149142 A2 9/2014
WO WO 2016210101 A1 * 12/2016 ..... F41A 21/30

* cited by examiner

*Primary Examiner* — Gabriel Klein
(74) *Attorney, Agent, or Firm* — McCoy Russell LLP

(57) ABSTRACT

Methods and systems are provided for a sound suppressor adapted to be coupled to a firearm and including one or more baffle sections positioned within a body of the suppressor. In one embodiment, a sound suppressor comprises a unitary single-piece body, where a baffle section is positioned within the body and encapsulated by the body, the body and the baffle section forming one or more chambers, where the body and baffle section are formed integrally.

20 Claims, 18 Drawing Sheets

FIREARM SUPPRESSOR

CROSS-REFERENCE TO RELATED APPLICATIONS

The present application claims priority to U.S. Provisional Patent Application No. 62/279,555 entitled "FIREARM SUPPRESSOR", filed Jan. 15, 2016, the entire contents of which are hereby incorporated by reference for all purposes.

FIELD

Embodiments of the subject matter disclosed herein relate to firearm sound silencers and, in one example, to a sound suppressor.

BACKGROUND

Firearms suppressors (also commonly referred to as silencers) are mechanical pressure reduction devices that contain a hole through the center of the device to allow the passage of a projectile such as a bullet. Firearm suppressors are typically affixed to the muzzle of a firearm at the front end of the weapon. The firearm suppressor, when in action, lowers the energy of the projectile propellant gases as they are exhausted within the firing chamber and behind the projectile in order to reduce the energy signature(s) of the exhaust gases. The exhaust gases are primarily the byproduct of nitrocellulose combusting in the confined space of the cartridge case and firearm bore. The exhaust gases may therefore increase the pressure in the firearm bore. Shorter barreled firearms may experience an increased percentage of propellant solids in the gas stream. The exhaust gases are often moving at supersonic speeds through the bore and the high energy of the combined gas and particulate matter may often lead to erosion, impingement, and/or deformation of the firearm suppressor. The areas of the suppressor nearest to the firearm exhaust (muzzle) and in line with the firearm bore may be exposed to the highest energy levels and may be most susceptible to erosion and impingement resultant from the exhaust gas and particulate mixture discussed above which may limit the application and duty cycle of the suppressor.

Other attempts to address the drawbacks associated with high energy erosion of the suppressor include constructing a suppressor with an inner sleeve and constructing a plurality of suppressor inserts. One example approach is shown by U.S. Pat. No. 8,087,338 Hines et al. Therein, the firearm suppressor comprises an internal insert sleeve member with a plurality of inserts and chambers disposed at locations along the insert sleeve. The inserts are removable from the insert sleeve and can be replaced and welded therein. However, the inventors herein have recognized potential issues with such systems. As one example, the welded inserts are vulnerable to attrition caused by the high energy gasses at the area of the suppressor nearest the firearm muzzle when projectiles are fired through the weapon when using the suppressor. Therefore, as recognized by the inventors herein, a more robust construction of a suppressor housing coupled to inserts may be necessary in order to extend the lifetime of the firearm suppressor.

In one embodiment, the issues described above may be addressed by a suppressor comprising a baffle system further comprising a complex geometry that may better distribute and disperse the exhaust gases and particulate material dispelled by the firearm. For example, when the complex geometry baffle system is provided in a suppressor during additive manufacturing, or 3-D printing, in one embodiment, the suppressor may be formed integrally via 3-D printing small horizontal subsections of the suppressor at a time. The suppressor may be formed as an integrally single unitary piece, at least in one embodiment.

In another embodiment, the suppressor may be operatively configured to be attached to a firearm. The suppressor may include a tubular housing body defining a longitudinal or central axis, wherein the baffle sections of the suppressor are integrated and encased within the tubular housing component. In this way, the interior baffle section(s) may be surrounded by a housing such that the efficiency and efficacy of the suppressor are maintained.

In one example, the suppressor system may include an interior portion comprising a plurality of chambers, and the plurality of chambers may further comprise a complex geometry.

For example, in one embodiment, an interior portion of the suppressor may include baffle sections within the tubular housing which have a triangular helical profile, wherein the helix of the triangular helical profile rotates about an axis defined by the path of a projectile to be fired through the suppressor. An interior of the tubular housing may include helical sections that are integral with the tubular housing, which are discussed in more detail below. In examples where sound suppressor includes helical sections and baffle sections, propellant gases may travel through a region of the sound suppressor formed within the tubular housing between the interior of the tubular housing and an exterior surface of the baffle sections. Additionally, in at least one example, the plurality of triangular and helical baffle section(s) of the suppressor may further include a partially hollow interior section that may contain small u-shaped passages along an axis defined by a path of a projectile to be fired through the suppressor (e.g., the central axis). In such examples where the baffle sections include a partially hollow interior section containing small u-shaped passages along the central axis, the propellant gases may travel through a region of the sound suppressor formed within the tubular housing between the interior of the housing and the exterior of the baffle sections, and the propellant gases may further travel through the hollow interior sections (e.g., u-shaped passages) of the baffle.

Inclusion of such baffle sections may contribute to increasing a residency time of propellant gases within the sound suppressor, thus helping to reduce a sound of the firearm during a firing event. It will be appreciated that in at least one example, the interior portions of the suppressor such as the baffle section briefly mentioned above may also be integrally formed along with the tubular housing portion. The interior baffle portions may be spaced along the interior of the tubular housing body at constant or varied distances. In addition, the area defined by the triangular helix of the baffle section that is not in direct contact with the interior wall of the tubular housing body may define the one or more expansion chambers, wherein components of propellant gases resulting from a discharged projectile may expand, slow in forward momentum, and reduce in temperature and pressure.

The tubular housing body may further comprise a projectile entrance portion and a projectile exit portion disposed at a longitudinally rearward region and a longitudinally forward region, respectively. The rearward end of the suppressor may have an opening sufficiently large enough to permit passage of at least a portion of a firearm barrel, where the silencer may attach via connectable interaction devices such as interlacing threads.

In another embodiment, the suppressor may include a set of interior projections along the projectile passage path near the projectile entrance portion at a longitudinally rearward portion and disposed within a first chamber area of the suppressor. The projections may be formed integrally similarly to the helical sections and the baffle sections referenced above.

In this way, a firearm suppressor may be able to withstand the potentially corrosive effects of projectile propellant gases, and the lifetime of the suppressor may therefore be extended and the overall costs of owning and using a suppressor may be reduced. Other elements of the disclosed embodiments of the present subject matter are provided in detail herein.

It should be understood that the summary above is provided to introduce in simplified form, a selection of concepts that are further described in the detailed description. It is not meant to identify key or essential features of the subject matter. Furthermore, the disclosed subject matter is not limited to implementations that solve any disadvantages noted above or in any part of this disclosure.

The above drawings are to scale, although other relative dimensions may be used, if desired. The drawings may depict components directly touching one another and in direct contact with one another and/or adjacent to one another, although such positional relationships may be modified, if desired. Further, the drawings may show components spaced away from one another without intervening components therebetween, although such relationships again, could be modified, if desired.

DETAILED DESCRIPTION

The following description relates to various embodiments of a sound suppressor (also commonly referred to as a silencer), as well as methods of manufacturing and using the device. Potential advantages of one or more of the example approaches described herein relate to maintaining the length and weight of the overall firearm and/or suppressor, while still enabling rapid cycling, reduced wear, improved heat resistance, reduced overheating, and various others as explained herein.

Figure 1:
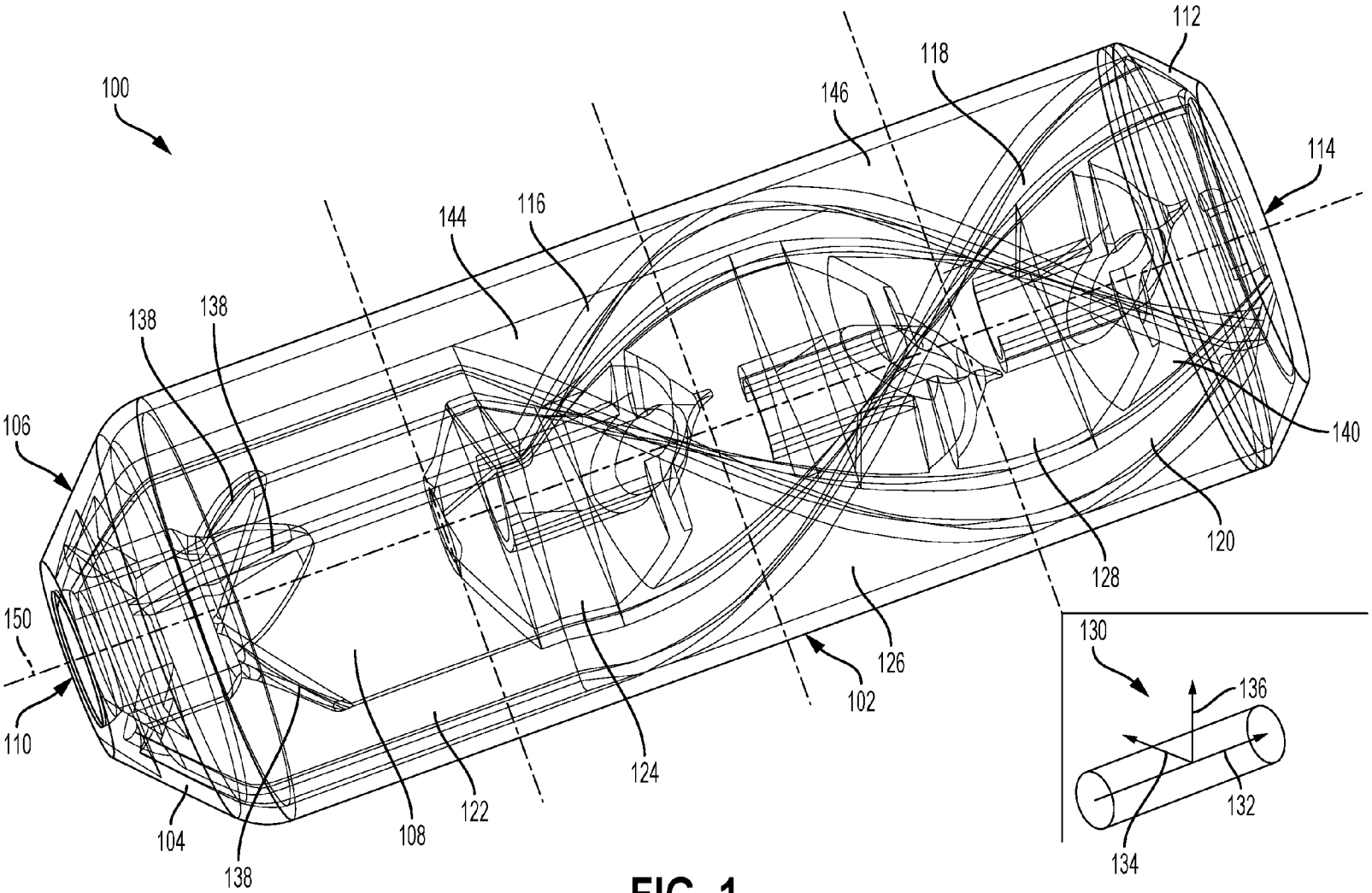
FIG. 1 is a transparent wireframe view of an example suppressor assembly with an elongate tubular housing and an interior baffle section.

In accordance with the above and further objects of the subject matter, the present application discloses a firearm noise suppressor for reducing the sound resultant from the expanding gases expelled from the muzzle region of a firearm's barrel. In one embodiment, the firearm noise suppressor may include an elongated tubular housing, wherein portions of one or more interior baffle sections are fully or partially encapsulated securely within one or more materials of the tubular housing. The interior baffle sections may take the shape of a triangular helix and may further be spaced longitudinally along the interior of the tubular housing as shown in FIG. 1. A series of baffles as well as their shape may create turbulence of the gas, slowing its motion and reducing its temperature and pressure. The surface bounded by the inner housing surfaces contiguous with adjacent baffles may form a plurality of sufficiently large expansion chambers, wherein the propellant gases' motion may be hindered or slowed, and the pressure and/or temperature may be reduced.

The baffle section, as shown in FIGS. 1-17 and described herein, may perform several functions at once, such as mounting, wear reduction, and optimized geometry for example. In addition, the baffle section may comprise a complex geometry allowing it to interface with the exterior component, the tubular housing and may mechanically transmit force to the exterior component through a mechanism other than the simple adhesion between the insert and the exterior component. The exterior tubular housing may be configured in some examples to include threads, ribs, lugs, flutes, etc. Alternatively, the baffles may interface with the encapsulating tubular housing in the absence of additional geometry other than the interfacing surfaces of the baffle section, instead of using frictional forces to mechanically transmit force to the exterior component in the absence of adhesion between the baffle section and the exterior component.

Referring now to FIG. 1, an example embodiment of the suppressor assembly described herein is provided. The figure illustrates the suppressor assembly via a wireframe transparent solid in order to show the complex geometry exhibited by the interior portions of the suppressor. As shown in the figure, the suppressor assembly 100 may comprise a tubular housing 102, a rearward region 104, an outer surface 106, a projectile passage 110, a forward region 112, and an exit passage 114.

In one example, the tubular housing may comprise a non-circular shape and may further comprise one or more facets for example. For example, the tubular housing may comprise a non-circular exterior shape such as a round shape with one or more facets disposed along its perimeter. In yet a further embodiment, the non-circular exterior shape of the tubular housing may comprise a square, pentagonal, hexagonal, or any other non-circular shape such that at least one flat edge is provided.

The non-circular shape of the suppressor may allow for it to be set down such that the suppressor will not roll away for example although other technical effects of the non-circular shape may exist. It will be appreciated that in embodiments wherein the tubular housing 102 does not comprise a circular shape, the inner surface may remain primarily circular in nature.

The interior of the suppressor 100 may further comprise an interior surface 108, a first spiral flute section 116, a second spiral flute section 118, a third spiral flute section 120, a first chamber 122, a second chamber 124, a third chamber 126, a fourth chamber 128, and a plurality of interior projections 138. In one example, the interior components of the suppressor 100 such as the interior projections may be formed integrally such that the suppressor forms a single, unitary structure.

The projectile passage 110 and the projectile exit passage 114 may define the central axis 150 of the suppressor and the axis system of the suppressor may be defined by the axis/coordinate system 130 in the lower left section of FIG. 1. It is noted that in at least one example, a central axis 150 may also be an axis of a projectile to be fired through the sound suppressor system. The axis system 130 is comprised of three axes, longitudinal axis 132, vertical axis 136, and a lateral axis 134 wherein the vertical axis 136 and the lateral axis 134 each point radially outward from the central longitudinal axis 132. An actual central axis 150 of the firearm suppressor is depicted in the figures via a dashed line running along the length of the firearm suppressor 100 which corresponds to the longitudinal axis 132.

In some embodiments, the suppressor 100 may include at least a first expansion chamber (herein also referred to as a chamber) 122, a second chamber 124, a third chamber 126, and a fourth chamber 128 defined by the bounded interior void space of the tubular housing 102. The first expansion chamber 122 is of sufficient size to diminish the energy of the gases formed by the discharge of the firearm to a temperature and pressure that may reduce erosion of structural components of the suppressor. The gas may then travel through the one or more additional channels formed by the baffle section to a second chamber 124 in fluidic communication with the first chamber 122, comprising the bounded interior space of the tubular housing between the baffle sections. In another embodiment, a third or more additional expansion chamber may be included in the construction of the suppressor. It will be appreciated that in at least one embodiment, the chambers 122, 124, 126, 128 may be formed integrally along with the tubular housing 102. In this way, a suppressor comprising a single, unitary body may be provided.

In some embodiments, the suppressor 100 may be made out of a plurality of materials, or by a plurality of conditions or treatments of the same material (e.g., coating, heat treatments, etc.). Materials used for components of the suppressor and interior baffle section may exist in different combinations as determined by application. In one example, the suppressor body (i.e. the tubular housing 102) may be formed from plastics, high nickel heat resistant alloys, titanium, or aluminum. In some examples, specific areas of the firearm suppressor may require geometry that may be difficult to manufacture as a singular component. Some geometry of the suppressor may also require manufacturing processes or operations that may be suboptimal in order to complete in a single part. In one example, the interior baffle section may be formed integrally along with the tubular housing such that the baffle section may not require insertion into the tubular housing 102. For example, the baffle section may be manufactured inside the tubular housing via an additive method of 3-D printing where the suppressor may be converted into a plurality of horizontal cross-sections and the entire cross-section may be manufactured via laying down thin amounts of material corresponding to each cross-section. In this way, a suppressor comprising a single, uninterrupted, and unitary body may be produced.

The suppressor of FIG. 1 may comprise a projectile passage 110 forming a generally annular channel at a rearward region 104 wherethrough a projectile such as a bullet may enter, travel through a plurality of channels or chambers 122, 124, 126, 128 formed by openings of one or more adjacent baffle sections 140, 144, 146, and may then exit the sound suppressor 100 via an exit passage 114 at a longitudinally forward region 112. In one example of utilizing the sound suppressor 100, the longitudinally rearward region 104 may be abutted toward a muzzle portion of the barrel of a firearm, and the sound suppressor may be coupled to the muzzle portion of the barrel of the firearm at the longitudinally rearward region of the sound suppressor 100.

In one example, the tubular housing 102 including an outer surface 106 and an inner surface 108 may comprise a homogenous component material including, but not limited to, plastics, high nickel heat resistant alloys, titanium, or aluminum. In some embodiments, the housing may be manufactured via processes including but not limited to, 3-D printing (e.g. selective laser melting (SLM), fused deposition modeling (FDM), sterolithography (SLA) and laminated object manufacturing (LOM)), casting, molding, additive manufacturing, or forgoing. In yet another example embodiment, the tubular housing 102 may be made by excavating out the homogenous parent material to form the housing lumen 142 in order to fit the plurality of baffles therein. Further, one form of manufacture may include drilling out or another means of removing material in order to form the insert mount locations. The outer surface 106 may include an exterior marking 154. The exterior marking 154 may be formed during the additive manufacturing process of the suppressor 100. The additive manufacturing process (i.e. 3-D printing) for example, may build the suppressor 100 from the ground up, and may skip layers during the process in order to create an exterior marking 154 that may appear to be imprinted into the final suppressor product.

Alternatively, the additive process may lay extra material onto the suppressor during manufacturing such that the exterior marking 154 may appear to be raised atop the outer surface 106 of the tubular housing 102 of the final suppressor product. Further still, the exterior marking 154 may include multiple components, some of which may appear raised, and some of which may appear imprinted on the outer surface 106 of the suppressor 100. In one embodiment, each suppressor may have a unique identifying number such as a serial number for example and manufacturer information such as the manufacturers name and location. Some regulating bodies may require such information to be displayed on each suppressor unit. Forming the exterior marking 154 on the outer surface 106 during the manufacturing process of the entire suppressor may reduce the additional cost, time, and difficulty associated with adding the exterior markings via a different process after the suppressor has been manufactured such as a post-manufacturing process. In one example, the resulting structure of the suppressor may include a plurality of adjacent layers of material integrally formed with one another wherein extra layers and/or missing layers are positioned to, in combination, form the exterior marking such as a logo or identifying information.

In another example, the inner surface 108 of the tubular housing 102 may comprise one or more projections 138 axially protruding from the central axis 150 and outwardly toward the inner surface 108 of the tubular housing 102. In one example, the suppressor 100 may include a plurality of projections 138 and the projections may extend axially and expand outward from one another to give rise to a blossom type shape wherein each of the one or more projections are positioned apart from one another at a lateral angle of greater than 90 degrees. In another embodiment, the projections may have one or more indented and concentric grooves along the projection's inner surface, having a generally annular shape, if viewed in a cross-sectional perspective. Such grooves may be disposed in the projections coaxial to the central axis 150 of the tubular housing 102.

In one embodiment, the tubular housing 102 material may fully encapsulate the projections 138 and the baffle section 300 along its entire circumference. In other examples, a blast baffle unit or a combination of baffles and projections 138 may be used. In some examples, the encapsulation and formation of the baffle section 300 and the projections 138 may be performed during the manufacturing of the encapsulating component. In this case, the baffle section 300 and the interior projections 138 may be formed integrally along with the tubular housing 102 such that there are no gaps or junctions between the interior components and the tubular housing. The baffle section and the projections 138 may also be retained in the housing by deformation of the housing subsequent to its manufacture. These processes may include, but are not limited to: casting, staking, forming, etc. In some embodiments, the baffle and projections may be manufactured via processes including, but not limited to: selective laser melting (SLM), direct metal laser sintering (DMLS), selective laser sintering (SLS), fused deposition modeling (FDM), stereolithography (SLA) and laminated object manufacturing (LOM). Thus, the secured interface between the housing and the projections and baffle section may be substantially permanent such that the propellant gases resultant from projectile discharge may impart reduced vibrational or high pressure damage to the sound suppressor. In an alternate embodiment, the projections may be retained within the housing by frictional forces. In this embodiment, an inner circumferential face of the projections 138 may interface via face sharing contact with an exterior circumferential face of a projection. In this way, frictional forces between these mated surfaces may hold the projections in place without any additional coupling elements such as an adhesive, welding, or another type of suitable fixture.

Further, the manufacturing surfaces described above may create a bond between the face-sharing surfaces of the projections and the corresponding baffle section. In yet another embodiment, the projections may be made within the suppressor as part of one single and continuous 3-D printing process. For example, the interior components may be manufactured in the same uninterrupted printing process as used for the exterior housing. In this way, the suppressor may be produced inclusive of all of the above described internal components and there may not exist gaps or union junctions such as welds between the components. In this way, the process may yield a single unitary suppressor devoid of welds, fittings, threads, seams, or any other adhesive properties between the tubular housing 102 and the projections 138 and baffle assembly 300 other than the internal strength of the printed material itself. For example, when utilizing a DMLS printing process, the suppressor including the projections and baffle assembly may be printed in one continuous process, so long as they are made of the same material, such as Inconel (an alloy of nickel containing chromium and iron, which is resistant to corrosion at high temperatures). In this embodiment, the final product is a suppressor with projections and baffles made of the same material as the tubular housing body that is printed via the same DMLS process in order to form a single unitary body. As such, the housing and the projections and baffle section of the suppressor may be integrated with one another as one continuous piece.

In another embodiment, a plurality of projections 138 may extend axially outward along a central axis 150 that defines the projectile path through the suppressor, and may span various widths along the housing's longitudinal axis 132. In other embodiments, the projections may extend substantially outward away from the central axis of the housing 102 such that the projections extend more than the lateral radius of the projectile passage. This may form only a small opening through which to allow passage of the projectile that may travel therethrough. In this particular example, at a longitudinally forward region 112 of the suppressor 100, an exit passage which may define the end of the projectile path is disposed. Various combinations of parameters of distance including the length of the outward extension of the projections and widths along the housing's longitudinal axis may be made.

In some example embodiments, a baffle assembly 300 may be provided at a position along the longitudinal axis 132 substantially forward from the projections 138. The baffle section 300 may comprise a complex geometry most similar to a triangular helix wherein the interior of the triangular helix may be partially hollow and may further comprise a u-shaped groove 502 along the central axis defined by the projectile path. The baffle section may be comprised of a forward baffle section 140, a middle baffle portion 146, and a rearward baffle portion 144 and the three sections may be joined to one another to form an immovable, unitary, and uninterrupted contiguous interface. Further, the baffle section may be joined to the tubular housing 102 free of welds or adhesives to form an immovable, unitary, uninterrupted, and contiguous interface. In some examples, the baffle may be at least partially substantially encapsulated by the housing and the formation of the baffle assembly may be performed during the manufacturing of the encapsulating component. These processes may include, but are not limited to: casting, staking, forming, etc. In some embodiments, the baffle sections may be manufactured via processes including but not limited to: selective laser melting (SLM), direct metal laser sintering (DMLS), selective laser sintering (SLS), fused deposition modeling (FDM) stereolithography (SLA) and laminated object manufacturing (LOM). Thus, the secured interface between the housing and the baffle sections may be considerably permanent such that the propellant gases resultant from projectile discharge may impart reduced vibrational or high pressure damage to the sound suppressor.

In one example, the width of the baffle sections may be variable when compared to the longitudinal width of the projections along the longitudinal axis 132. For example, the baffle sections may be shorter or longer than the projections and may be shorter or longer compared to one another or may be the same or substantially similar width as the projection.

Figure 2:
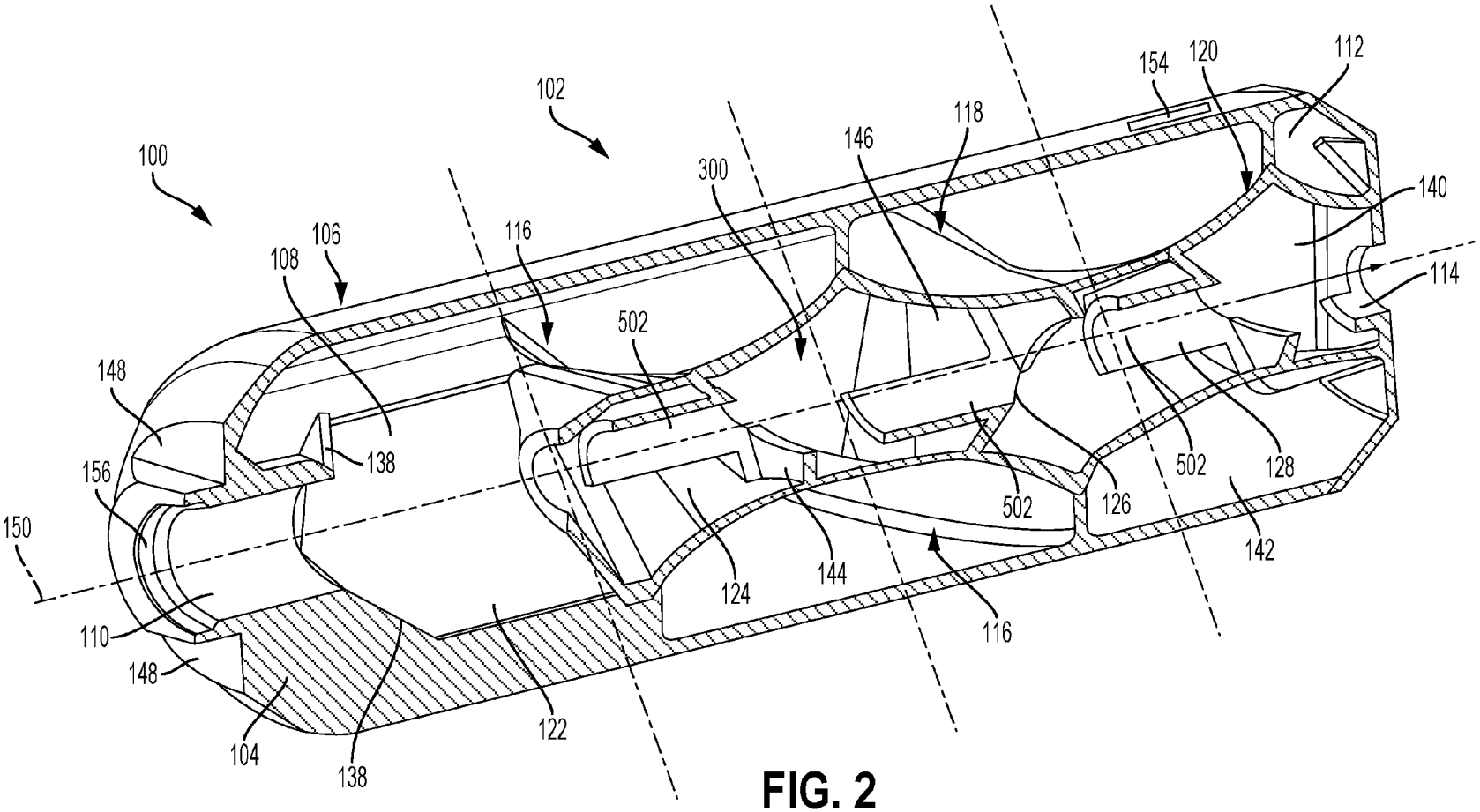
FIG. 2 is a cross-sectional cutaway view of an example suppressor assembly.

FIG. 2 further illustrates the inner surfaces 108 of the tubular housing 102, the projections 138, and a rearward interior junction 154 at a rear position of the rearward interior baffle section 144 that define a first expansion chamber 122. Similarly, the inner surface 108 of the tubular housing 102 a first helical flute section 116, a second helical flute section 118, a third helical flute section 120, and forward lateral face of a rearward interior baffle section 144 defining a second expansion chamber 124 is shown. The helical fluted sections may extend towards a central axis of the suppressor, and the helical fluted sections may be formed integrally with a tubular housing of the suppressor. Further, a third expansion chamber 126 disposed within the interior of the suppressor 100 is shown. The third expansion chamber 126 may be defined by a junction 152 between a rearward baffle section 144 and a middle baffle section 146 between a first helical flute section 116, a second helical flute section 118, a third helical flute section 120, and an inner surface 108 of the housing encapsulated within the tubular housing 102. It will be appreciated that in at least one example, the baffle section may be manufactured as a single unitary and integral piece devoid of junctions such as welds. Further, in another example, the entire baffle assembly 300 section may be formed integrally along with the tubular housing 102. In this way, a single, unitary suppressor may be produced in a single, uninterrupted manufacturing process. Additionally, a fourth expansion chamber 128 is shown in FIG. 2 as being defined by a forward baffle portion 140, a junction 152 between the forward baffle section 140 and a middle baffle section 144, a first helical flute section 116, a second helical flute section 118, a third helical flute section 120, and an inner surface 108 of the tubular housing 102.

Specifically, FIG. 2 shows a cross-sectional cutaway view of the suppressor 100 embodiment as depicted in FIG. 1. In this figure, the inner surface 108 and the baffles 140, 144, 146 may be more clearly illustrated. The central axis 150 of the suppressor 100 is defined in this embodiment by the path of a projectile to be fired through the suppressor 100. The projectile path 110 may begin at a rearward region 104 of the suppressor and end at a longitudinally forward region 112 at an exit passage 114. The projectile path may be inclusive of a way of fastening the suppressor to a firearm such as threads 156 or another suitable means of coupling. The threads 156 of this suppressor embodiment may be disposed within a longitudinal protrusion along the central axis 150 of the suppressor at a rearward region 104 of the device. The rearward longitudinal protrusion may be further inclusive of one or more 90 degree grooves 148. The grooves 148 may serve as a way to stabilize the suppressor unit when affixed to the bore of a firearm for example.

Further, as noted briefly above with reference to FIG. 1, a plurality of expansion chambers 122, 124, 126, 128 are illustrated in a cutaway manner in FIG. 2. In this view, it may be further possible to visualize the projectile path along the baffle sections. For example, a first expansion chamber 122 is shown defined by an inner surface 108 of the tubular housing 102, a plurality of projections 138, and the rear face of a rearward baffle section 144. A second expansion chamber 124 is illustrated in this figure as being defined by the inner surface 108 of the tubular housing, a first helical flute section 116, a second helical flute section 118, a third helical flute section 120, and the circumferential body of the rearward baffle section 144. A third expansion chamber 126 is also shown in FIG. 2 and is defined by the inner surface 108 of the tubular housing 102, a first helical flute section 116, a second helical flute section 118, a third helical flute section, and the circumferential helical body of a middle baffle section 146. Additionally, in this embodiment of a suppressor 100, a fourth expansion chamber is illustrated being defined by an inner surface 108 of the tubular housing 102, a first helical flute section 116, a second helical flute section 118, a third helical flute section 120, and the body of a forward baffle portion 140.

In one example, the tubular housing may comprise a non-circular exterior shape such as a round shape with one or more facets disposed along its perimeter. In yet a further embodiment, the non-circular exterior shape of the tubular housing may comprise a square, pentagonal, hexagonal, or any other non-circular shape such that at least one flat edge is provided. It will be appreciated however, that embodiments of the disclosed suppressor comprising a non-circular exterior shape may maintain the circular interior shape as shown in the figures. In this way, the advantages of the interior components of the suppressor may be maintained.

In FIG. 2 it is further possible to view the partially hollow interior of the baffle assembly 300 comprising a forward 140, middle 146, and rearward 144 sections. The baffle sections 140, 144, 146 in some embodiments may be partially hollow and may further comprise a u-shaped groove 502 that may axially surround the central axis 150 defined by the projectile path. Each section of the baffle assembly 300, such as the forward portion 140, the middle portion 146, and the rearward portion 144 may comprise a similar u-shaped groove protrusion 502. Further, the u-shaped grooves 502 of each section of the baffle assembly may be staggered in one embodiment such that the grooves do not line up with one another. In this way, expelled gases may be further disrupted and distributed more evenly within the suppressor 100.

Figure 3:
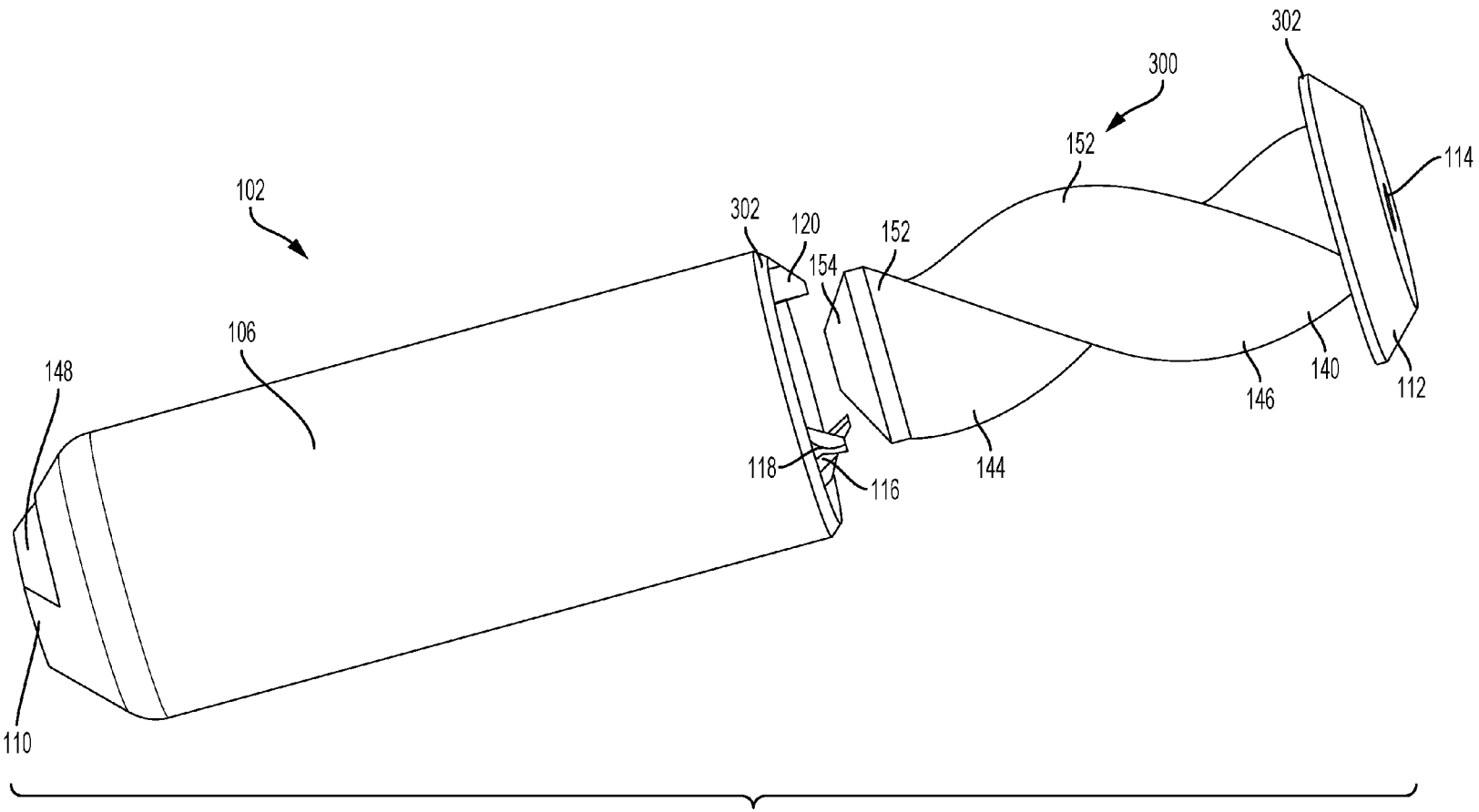
FIG. 3 illustrates the elongate tubular housing and the interior baffle section of the suppressor assembly separate from one another.

Turning now to FIG. 3, this figure provides a partially exploded view of the components of a suppressor 100 according to the present disclosure. Specifically, the tubular housing 102 and the baffle assembly 300 are shown apart from one another to illustrate how the two components relate to one another. It will be understood that the figure is provided solely for illustrative purposes and the embodiment depicted is not to be viewed in a limiting sense. Further, in some embodiments, the tubular housing 102 and the baffle assembly 300 may be formed together such that a unitary, uninterrupted, and contiguous surface is achieved.

In some examples, the components of the firearm suppressor may be formed in the same continuous and uninterrupted manufacturing process and the processes may include, but are not limited to: selective laser melting (SLM), direct metal laser sintering (DMLS), selective laser sintering (SLS), fused deposition modeling (FDM), sterolithography (SLA), and laminated object manufacturing (LOM). Thus, the components may be considerably permanent such that the propellant gases resultant from projectile discharge may impart reduced vibrational or high pressure damage to the sound suppressor. For example, when utilizing the DMLS printing process, the suppressor and internal components may be printed in one continuous process, so long as the components are constructed of the same material. In at least one embodiment, the final product is a suppressor with internal baffles made of the same material as the housing 102 that is printed via DMLS, to form a single unitary body. As such, the housing body and the internal components such as the baffle section may be integrated with one another as a single continuous piece.

In one embodiment, the tubular housing 102 of the suppressor 100 may be joined to the interior baffle assembly section 300 at an interface 302 at the rear of a forward baffle section 140 and a longitudinally forward section of the tubular housing 102. Further, the most forward face of the forward baffle section 140 may define a forward region 112 of the suppressor 100 and the forward region may comprise a circular hole at its forward face defining a projectile exit passage 114.

In this view, the helical nature of the fluting sections 116, 118, 120, and the baffle assembly may be readily apparent. As shown, the triangular helical baffle assembly 300 may be secured in the interior of the tubular housing 102 between the helical fluting sections 116, 118, 120 via the geometry of the helical fluting sections and the corresponding geometry of the baffle assembly 300.

Figure 4:
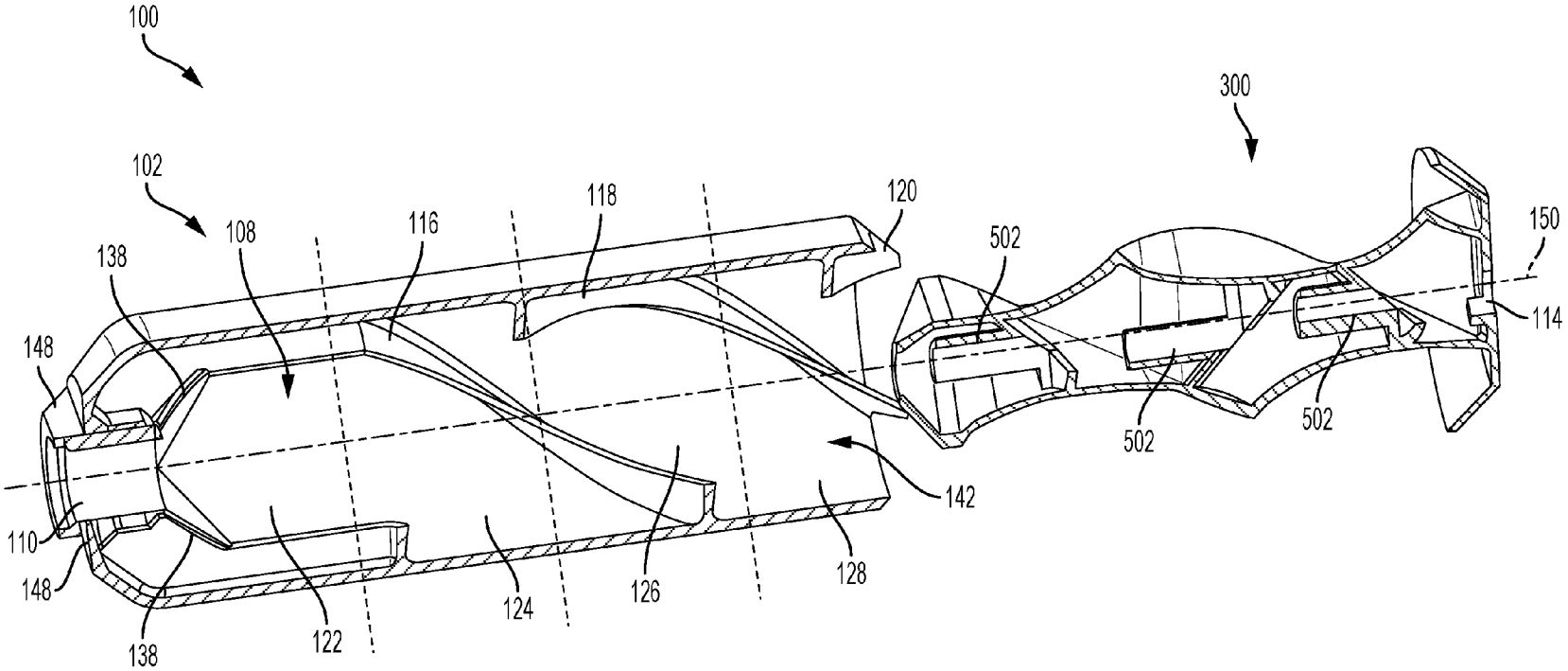
FIG. 4 is a cross-sectional cutaway view of the tubular housing and the interior baffle section separate form one another.

Turning now to FIG. 4, a cross-sectional cutaway view of FIG. 3 is presented. In this view, a housing lumen 142 is shown as defined by the inner surface 108 of the tubular housing 102 and a plurality of helical fluting sections 116, 118, 120. In this cutaway view, a plurality of expansion chambers 122, 124, 126, 128 may also be more clearly visible. The plurality of expansion chambers are depicted in FIG. 4 via a series of vertical dashed lines. Again, the figure is provided solely for illustrative purposes and in some embodiments, the tubular housing 102 and the baffle assembly 300 may be formed together in a single uninterrupted manufacturing process such that a single unitary surface may be achieved.

It will be appreciated that the expansion chambers 122, 124, 126, 128 are defined by the void space between the exterior faces of the baffle assembly 300 and the inner surface 108 of the tubular housing. In some embodiments, the baffle assembly may include a partially hollow interior as shown in FIG. 4 and the partially hollow interior may comprise a series of u-shaped grooves 502 along the central axis 150 as defined by the projectile path. It will be appreciated that the expansion chambers may be formed integrally along with the baffle section and the tubular housing such that the resultant suppressor may not include union junctions such as welds for example.

Figure 5:
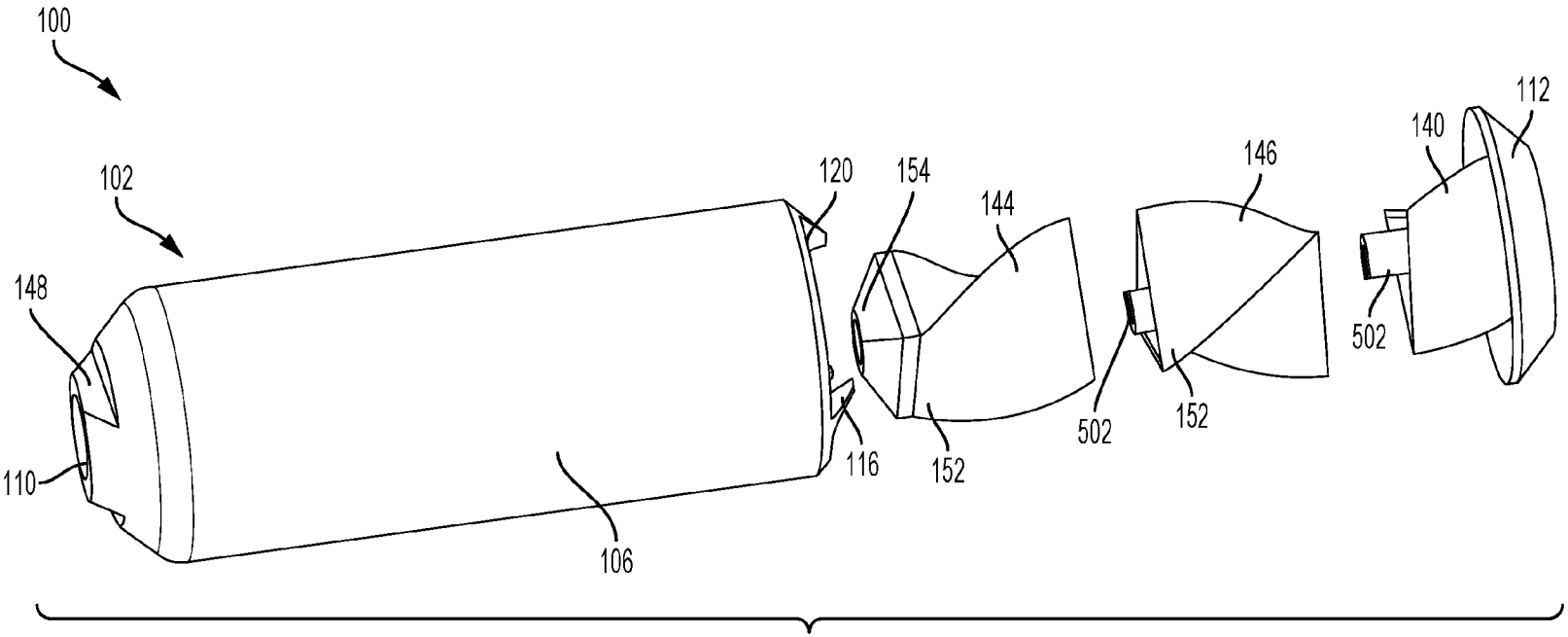
FIG. 5 is a partially exploded view of the suppressor assembly.

With respect to FIG. 5, this figure provides a fully exploded view of the components of a suppressor 100 embodiment according to the present disclosure. In this view, the triangular profile shape of the helical baffle assembly 300 may be more easily visible. As shown in this figure, the baffle assembly 300 may comprise individual sections that may be integrally formed in at least one embodiment. For example, the baffle assembly may comprise a forward baffle portion 140, a middle baffle portion 146, and a rearward baffle portion 144. The rearward baffle portion 144 may be fixedly attached to the middle baffle portion 146 at a junction 152 between the two sections such that the u-shaped grooves 502 of each portion are staggered. Similarly, a forward baffle portion 140 may be fixedly attached to a middle baffle portion 146 at a junction 152 between the two sections such that the u-shaped grooves of each component are staggered. Further, the three portions of the baffle assembly 300 may be fixedly attached to one another such that each u-shaped groove 152 of each portion are staggered and do not line up with one another. In at least one example, the baffle assembly may be constructed integrally such that the forward baffle portion 140, the middle baffle portion 146, and the rearward baffle portion 144 are fixedly coupled to one another free of welds or other union junctions.

Further, the rearward baffle portion 144 may further include a triangular helical protrusion 154 that defines the front wall of a first expansion chamber 122. In this way, the propellant gases resultant form firing a projectile may be at least partially distributed and dispersed in the first expansion chamber 122 prior to subsequently entering the baffle sections.

Figure 6:
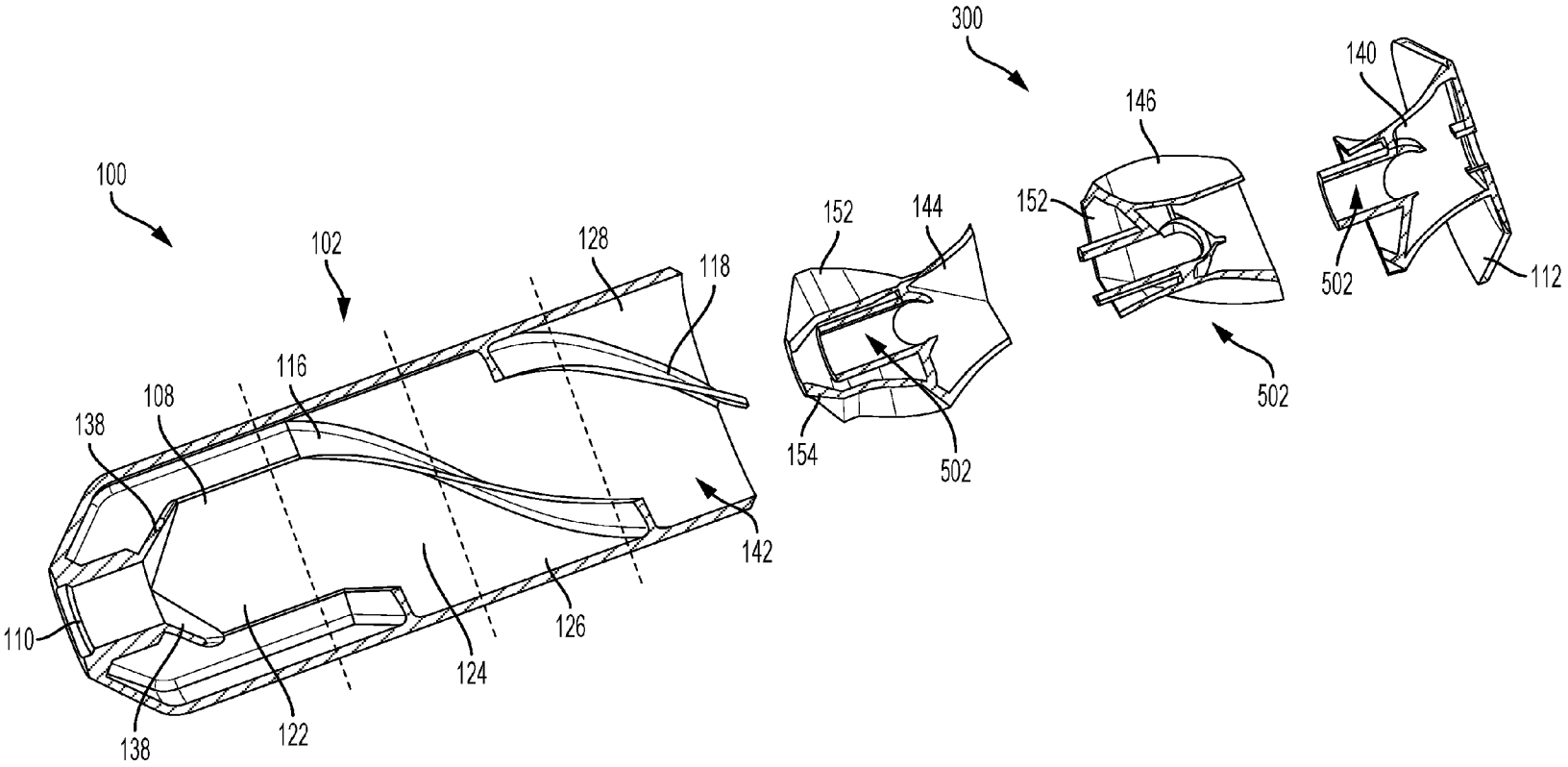
FIG. 6 is a cross-sectional cutaway view of a partially exploded suppressor assembly.

In FIG. 6, a cross-sectional cutaway view of FIG. 5 is provided. In this view the interior components and their physical relation to one another may be more clearly visible. As discussed above with reference to FIG. 2, a plurality of expansion chambers such as expansion chambers 122, 124, 126, and 128 as well as baffle sections such as baffle sections 140, 144, and 146 may be formed by integration of baffle sections into the housing via complementary helical fluting sections and projections extending a selected distance toward a central longitudinal axis such as the central axis 150 in FIG. 2.

It will be appreciated that the baffle sections as well as the fluting sections may exist in various combinations and locations along the housing lumen 142. A plurality of channels is formed by the entrance openings and exit openings of the baffle components arranged therein. A plurality of expansion chambers may be of sufficient size(s) so as to reduce or diminish the energy of gases formed by discharge of a firearm to a temperature and pressure that may reduce erosion of structural components of the suppressor. Following discharge of a projectile, the emitted combustion gases may travel in a forward direction through the one or more chambers formed by the boundaries of the baffle sections 140, 144, 146, the fluting sections 116, 118, 120, and/or the inner surface 108 of the housing. The gas may be transmitted through the chambers from a rearward region 104 of the suppressor, and each chamber may be in fluid communication with the adjacent chamber(s).

Figure 7:
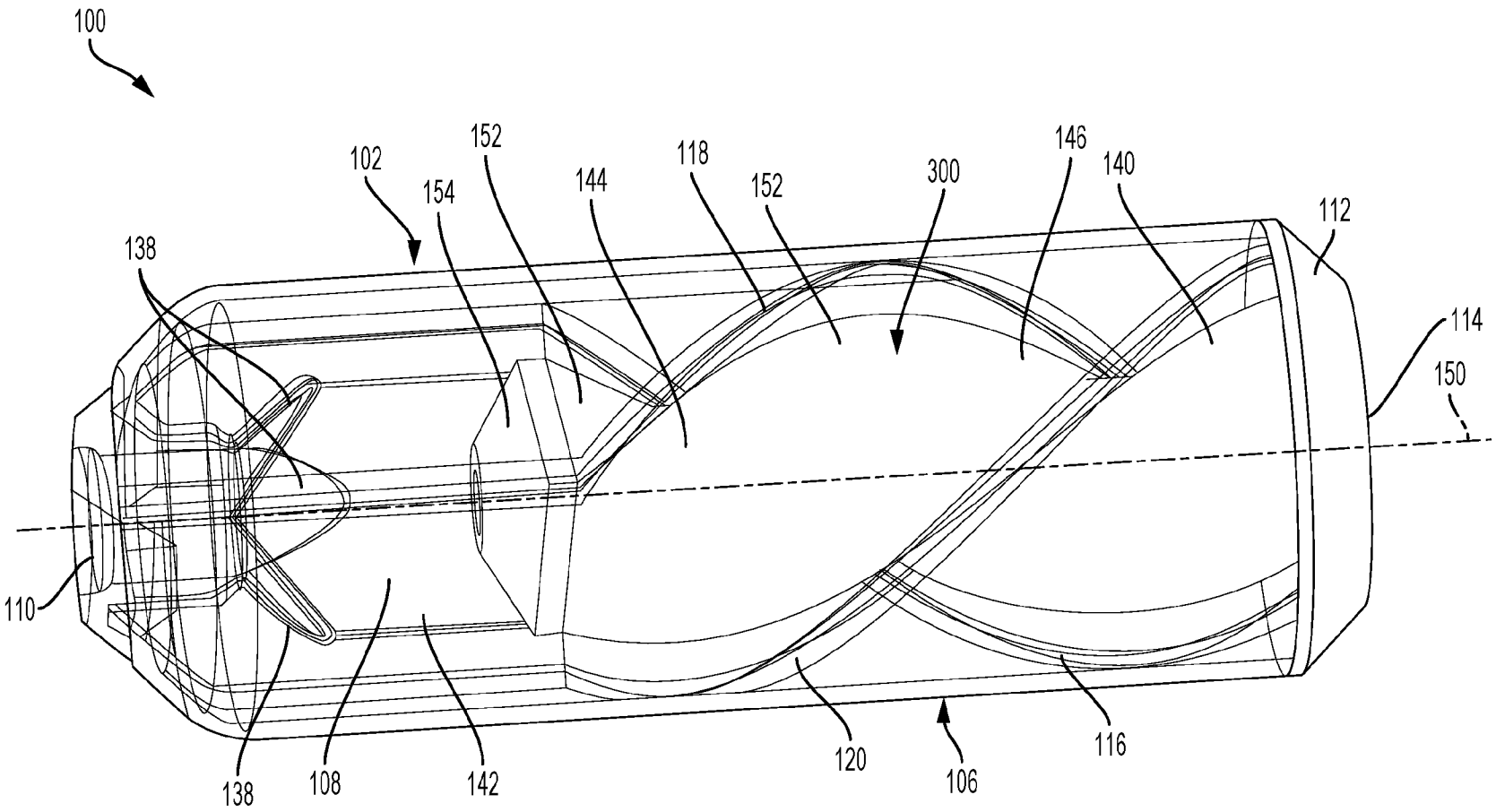
FIG. 7 illustrates how the interior baffle section of the suppressor assembly is disposed within the tubular housing.

Referring now to FIG. 7, this figure shows the components of a firearm suppressor 100 fixedly coupled to one another wherein the exterior portion (i.e. the tubular housing 102) is a transparent wireframe solid. As shown in this illustration, the helical flute sections 116, 118, 120 may be in direct face sharing contact with the outermost exterior edges of the triangular helical baffle assembly 300. In this view, it may also be further possible to view the void space between the triangular helical baffle assembly 300 and the inner surface 108 of the tubular housing 102. The void space may then form a series of expansion chambers as mentioned above. In this way, expelled gases resultant from the firing of a projectile may come into contact with more than one chamber and the efficacy of the suppressor 100 may be improved.

Figure 8:
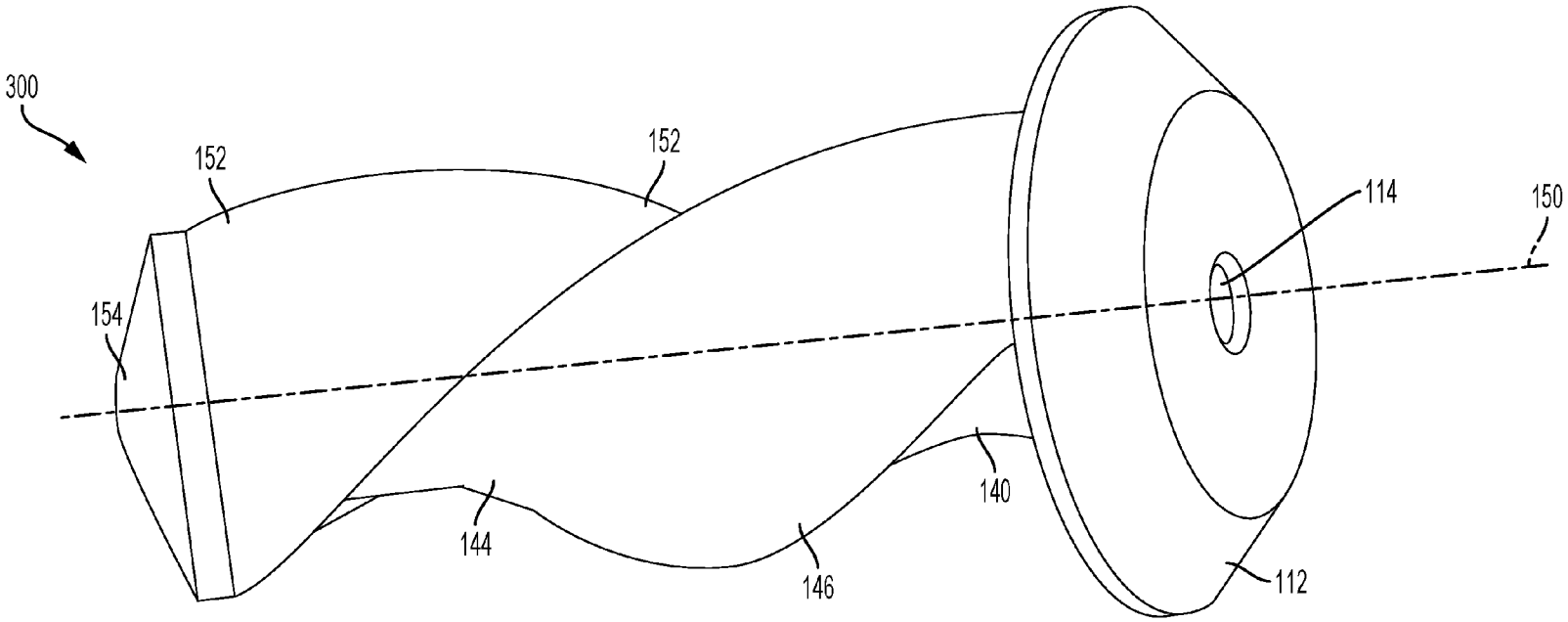
FIG. 8 is an enlarged perspective view of the interior baffle section assembly.

In FIG. 8, an enlarged perspective view of the interior baffle assembly 300 is provided. As discussed briefly above, the baffle assembly 300 may comprise a forward baffle portion 140, a middle baffle portion 146, a rearward baffle portion 144, and a hollow channel traversing the assembly longitudinally along a central axis 150. Further, the hollow channel defined by the central axis may end at a forward surface of the forward baffle section 140 which may also define a forward region 112 of the suppressor.

The interior baffle assembly 300 may, in some embodiments, further comprise two junctions 152 at which the three portions of the baffle assembly may be fixedly coupled to one another. Additionally, the rearward baffle portion 144 may include a triangular protrusion 154 that may define the forward face of a first expansion chamber such as expansion chamber 122 of FIG. 2.

Figure 9:
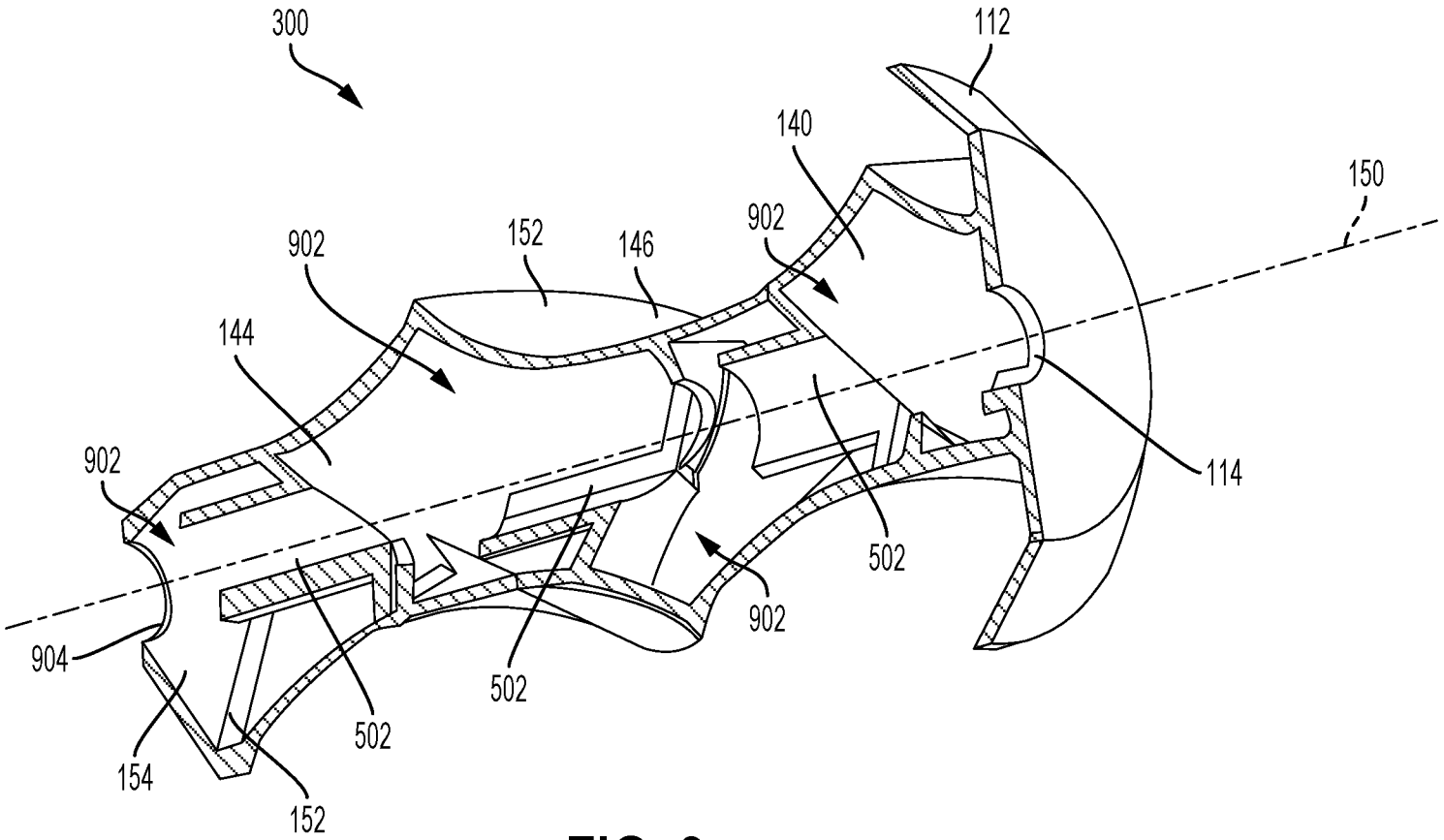
FIG. 9 is a cross-sectional cutaway view of FIG. 8

With respect to FIG. 9, a cross-sectional cutaway view of FIG. 8 is shown. In this view the hollow void space 902 of the interior of the baffle assembly 300 of one embodiment is illustrated. It will be appreciated that in one example, the hollow void space may be constructed in the same uninterrupted manufacturing process as described above such that the suppressor comprises a single unitary piece. As depicted in this figure, the projectile path defines a central axis 150 of the baffle sections and the suppressor as a whole. When a projectile enters the baffle assembly via a circular hole 904 at a rearward face of the rearward baffle portion 144, the projectile may travel along the central axis 150 through the subsequent baffle sections 146, 140 between u-shaped grooves 502 disposed along a central position along the central axis 150. The grooves 502 are not complete circles, and thus, may define a hollow void space 902 inside the baffle assembly 300 that is further defined by the inner surface of the baffle assembly. In this way, the expelled gases resultant from firing a projectile may be further dispersed and each subsequent chamber or baffle that the propellant gases travel through may experience a reduced temperature and/or pressure within the chamber relative to chambers and baffles of the suppressor.

Figure 10:
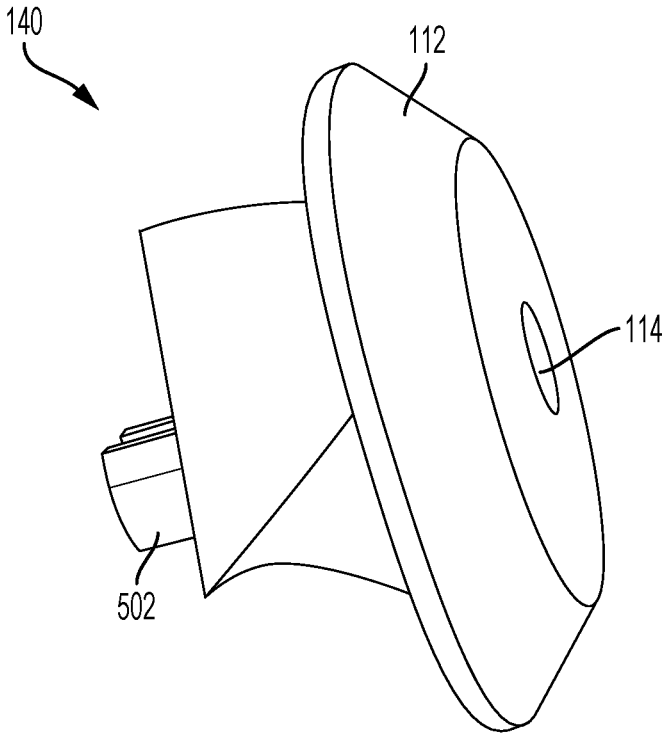
FIG. 10 is an enlarged perspective view of a forward region of the baffle section and firearm suppressor assembly.

Turning now to FIG. 10, an enlarged perspective view of a forward baffle section 140 is shown. As discussed above, the forward baffle section 140 may define a forward region 112 of the suppressor and may further comprise a u-shaped groove 502 disposed along the central axis of its interior area. The u-shaped groove 502 may further define a hollow void space (such as space 902 in FIG. 9) such that an additional chamber for propellant gases may be created in the void.

Figure 11:
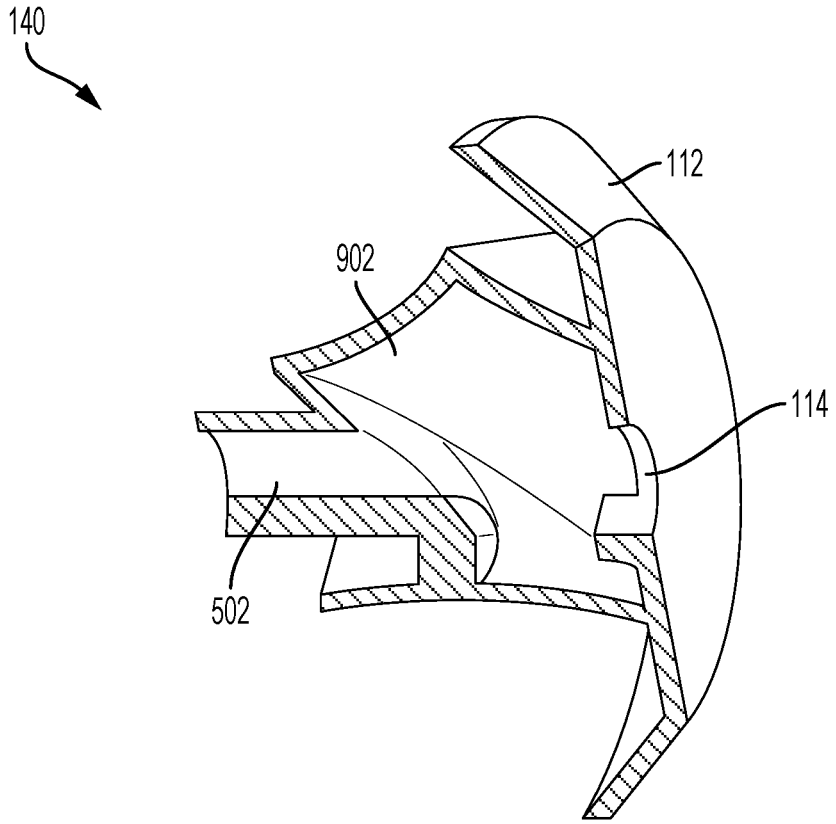
FIG. 11 is a cross-sectional cutaway view of FIG. 10.

FIG. 11 provides a cross-sectional cutaway view of the illustration provided in FIG. 10 and serves to better clarify the hollow void space 902 disposed within the interior of a forward baffle section 140. As depicted in this figure, the forward baffle section 140 may be shaped like a triangular helix and the interior hollow void space 902 may be defined by the interior surface of the forward baffle section 140 and the u-shaped grooves 502.

In one example embodiment, the u-shaped grooves 502 may serve as an additional guidance for a projectile fired through the suppressor, and since the hollow void space 902 is defined by the interior surface of the forward baffle section 140 and the u-shaped grooves 502 being non continuous, the propellant gases resultant from firing a projectile may exhibit a reduced temperature and/or pressure with each subsequent chamber and/or baffle it travels through. In this way, the efficacy of the suppressor may be improved when multiple chambers/and or baffles are used.

Figure 12:
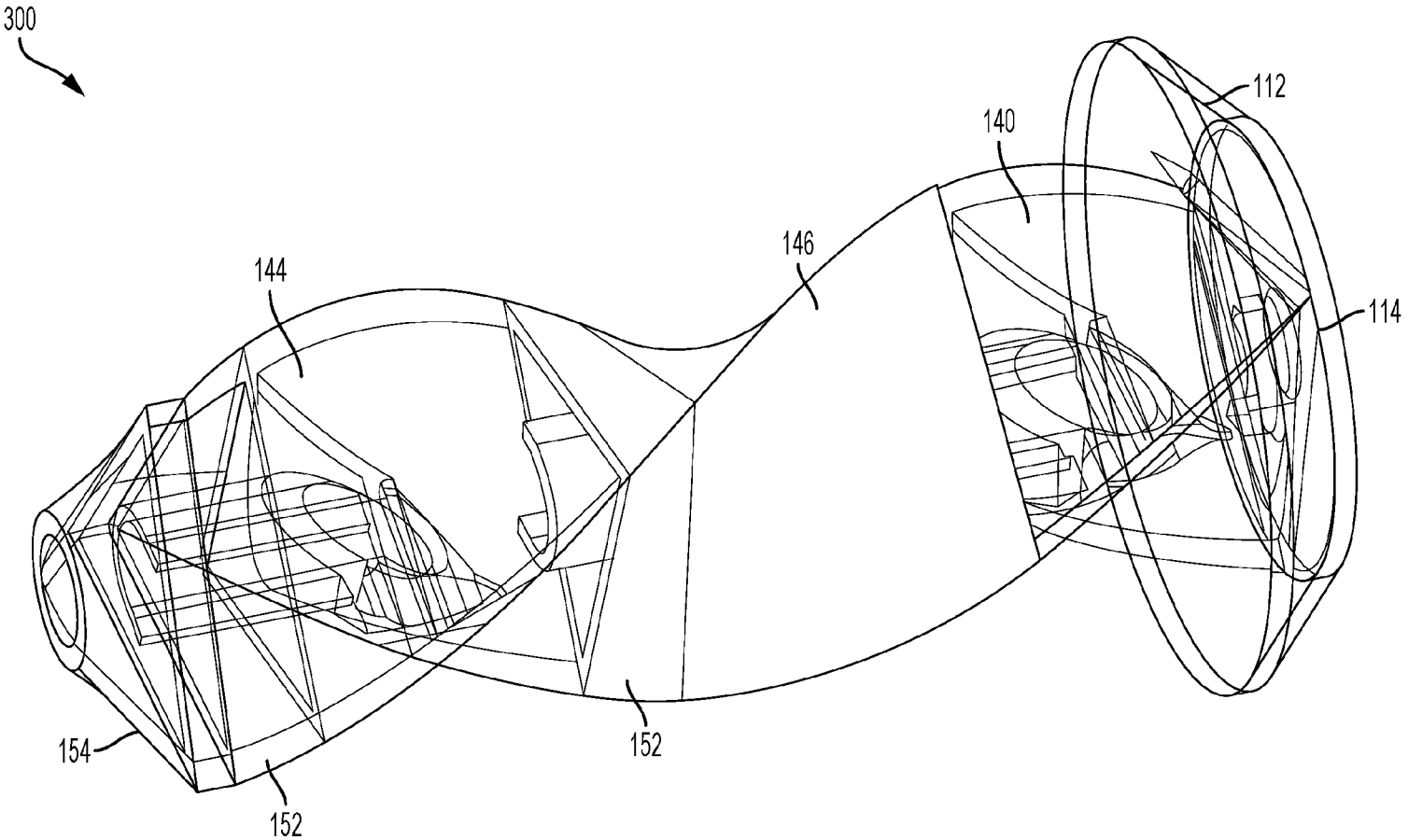
FIG. 12 is an enlarged perspective of a partially transparent and wireframe baffle section.

In FIG. 12, an enlarged perspective view of the baffle assembly 300 is provided. In this figure, a middle baffle section 146 is provided as a solid object fixedly coupled to a rearward baffle section 144 and a forward baffle section 140 which are shown as wireframe transparent solids. In this way, it may be possible to view the internal relationship of the components such as the u-shaped grooves 502 and the hollow void space 902 of FIG. 9 relative to each other component of the baffle assembly 300.

In this representation, it may be seen that the provided u-shaped grooves 502 are staggered such that they do not line up and coincide with one another. This staggering of grooves that may act as guidance or support grooves in one embodiment may allow for enhanced dispersal and/or dissipation of propellant gases. The u-shaped grooves may be disposed axially along a central axis (such as axis 150 of FIG. 2) and may be disposed longitudinally behind a forward projectile exit passage 114. The exit passage 114 may be disposed within the center of a front face of the forward baffle section 140 the front face may further define a forward region 112 of the suppressor 100.

Figure 13:
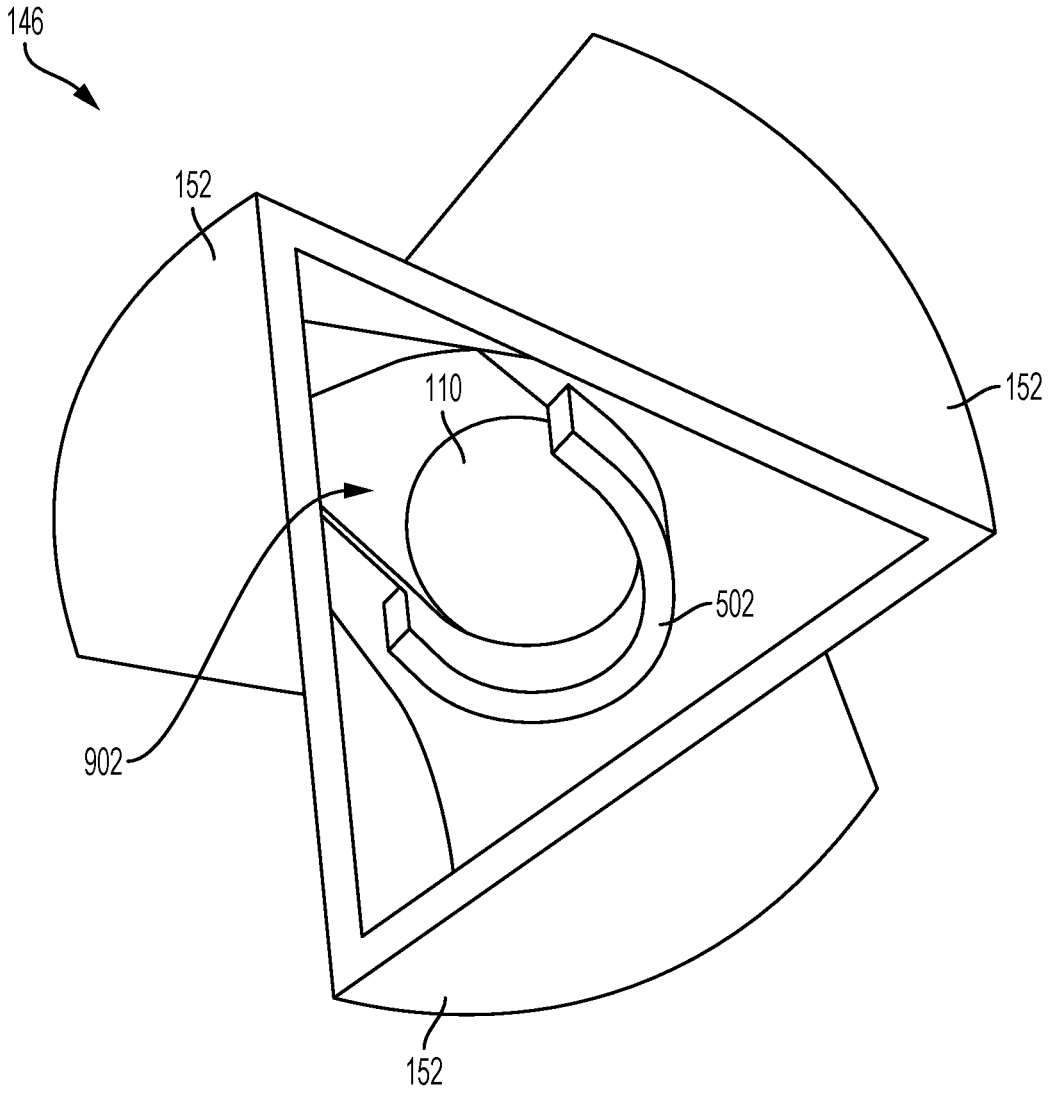
FIG. 13 is an enlarged rear perspective view of a middle portion of the baffle assembly.

The helical triangular nature of the baffle assembly 300 as well as the triangular helical nature of each baffle assembly component is shown in FIG. 13. In this figure, an enlarged rear perspective view of the middle baffle section 146 is shown. In this view, the hollow void space 902 that is defined by an inner surface of the baffle section and the u-shaped groove 502 may be more readily visible. The hollow void space 902 within the baffle section 146 may comprise a complex geometry and may serve to better disperse and/or distribute propellant gas pressure and/or heat.

Figure 14:
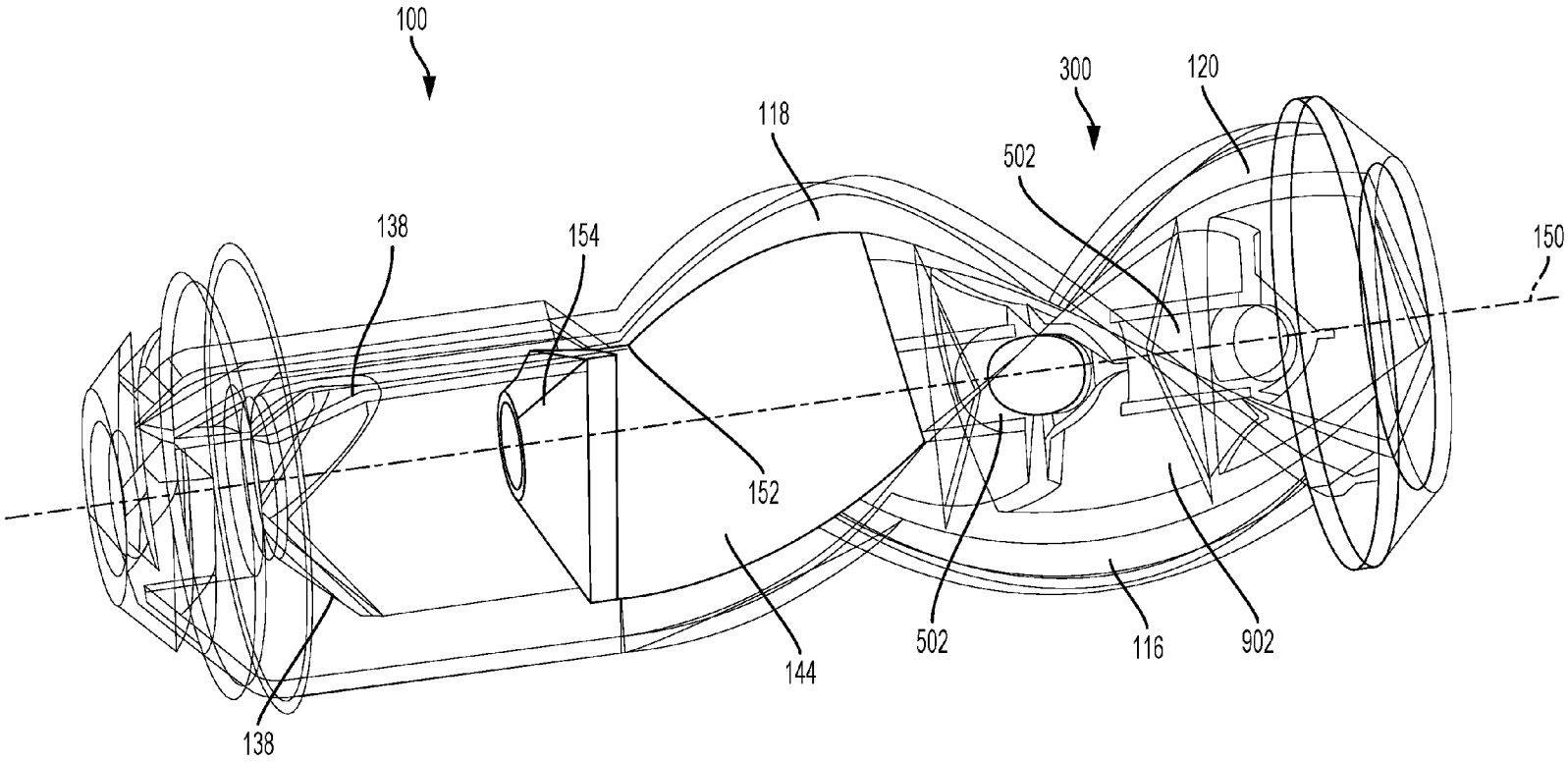
FIG. 14 shows a rearward interior baffle section affixed to a transparent wireframe suppressor assembly.

With respect to FIG. 14, similarly to FIG. 13, a rearward baffle portion 144 is depicted as a solid structure that is fixedly attached to the remainder of the baffle assembly 300 which is illustrated as a wireframe transparent solid, and is disposed within a tubular housing 102 shown here as a wireframe structure. In this view, the internal components of the tubular housing such as the helical flute sections 116, 118, 120 and projections 138 may be visible further illustrating their relationship to the baffle assembly 300, and defining a plurality of expansion chambers 122, 124, 126, 128.

Figure 15:
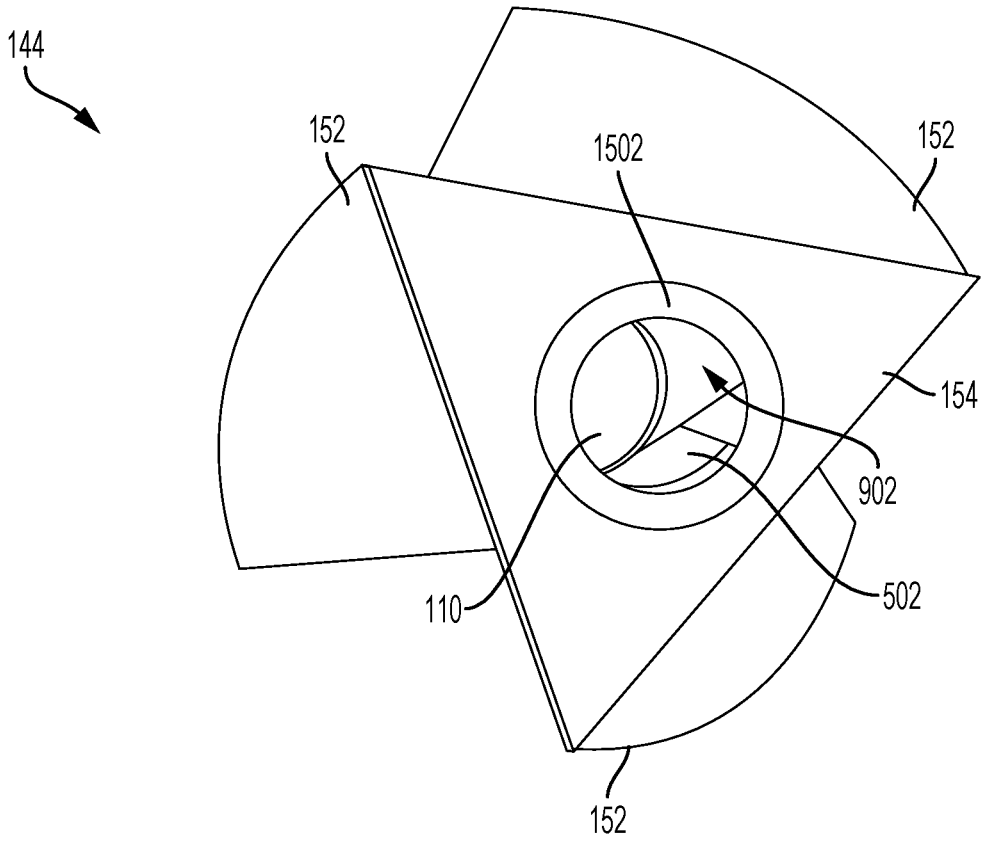
FIG. 15 is an enlarged rearward perspective view of a rearward baffle portion.

FIG. 15 provides an enlarged rear perspective view of a rearward baffle section 144 which may comprise a triangular protrusion 154 at a rearward face of the piece. The triangular protrusion may further include a circular hole 1502 disposed at a center of the protrusion 154 and may correspond to the placement and disposition of the u-shaped groove 502 within the baffle section's interior.

In this view, the hollow void space 902 within the interior area of the rearward baffle section 140 is also visible. Again, the hollow void space 902 may comprise a complex geometry and may further assist the suppressor 100 in dispersing energy and heat of propellant gases that result from the firing of a projectile from a firearm.

Figure 16:
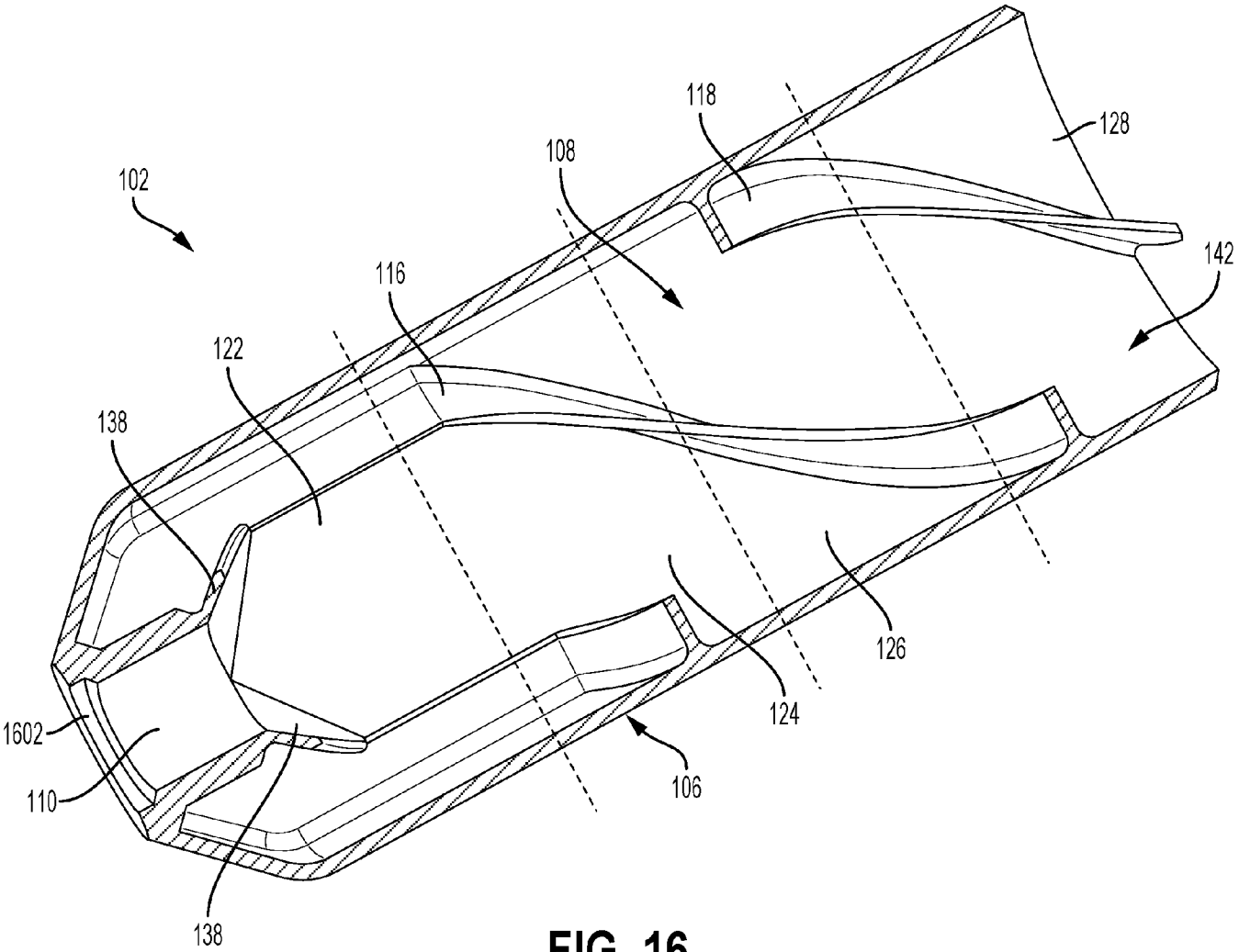
FIG. 16 is a cross-sectional cutaway view of the tubular housing.

In FIG. 16, an enlarged, perspective, cross-sectional cutaway view of the tubular housing 102 of the disclosed suppressor 100 is provided. In this figure, the baffle assembly 300 is removed to better illustrate the interior surface features of the tubular housing 102 such as a first helical flute section 116, a second helical flute section 118, a third helical flute section 120, and interior projections 138.

A plurality of expansion chambers may be provided in the suppressor and the chambers are depicted in this figure via a series of vertical dashed lines. Additionally, the tubular housing 102 may comprise an annular groove 1602. The annular groove 1602 may include features to affix the suppressor 100 to a firearm such as threading in one example. In this way, the suppressor 100 may be coupled to a firearm in a removable manner.

Figure 17:
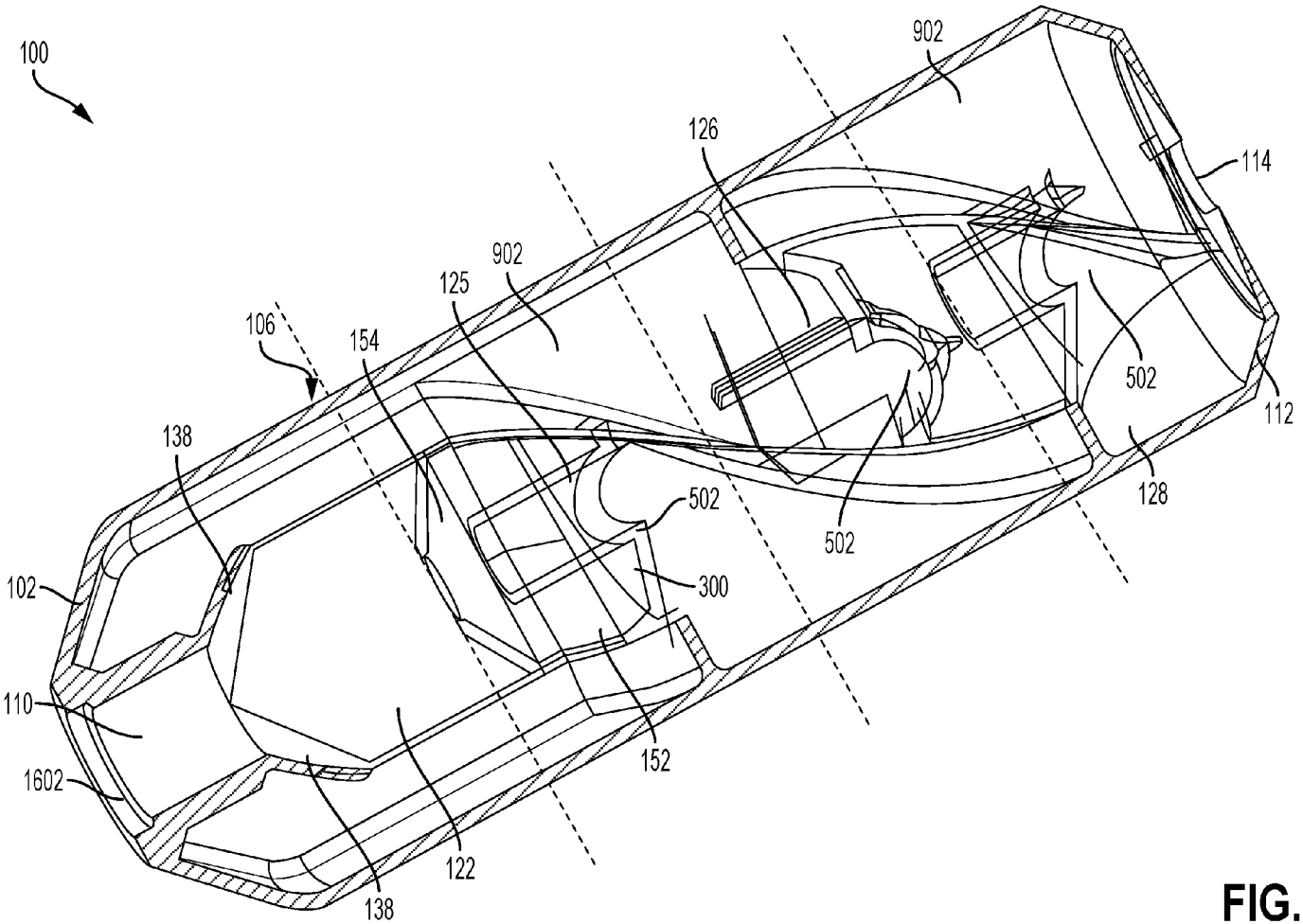
FIG. 17 shows a cross-sectional view of the tubular housing with a partial wireframe view of the interior baffle section.

The drawing of FIG. 17 provides an illustrative example of how the interior baffle assembly 300 relates and is integrated and disposed within the tubular housing 102. In this view, the baffle assembly 300 is depicted via a wireframe assembly and the tubular housing shown as a solid object in a cross-sectional cutaway.

In this figure, it may be visible and apparent that the projectile path as defined by the central axis may be inclusive of a projectile entrance path 110, a first expansion chamber 122, a rearward baffle section 144, a second expansion chamber 124, a middle baffle section 146, a third expansion chamber 126, a forward baffle section 140, a fourth expansion chamber 128, and a projectile exit passage 114 in at least one example embodiment.

Figure 18:
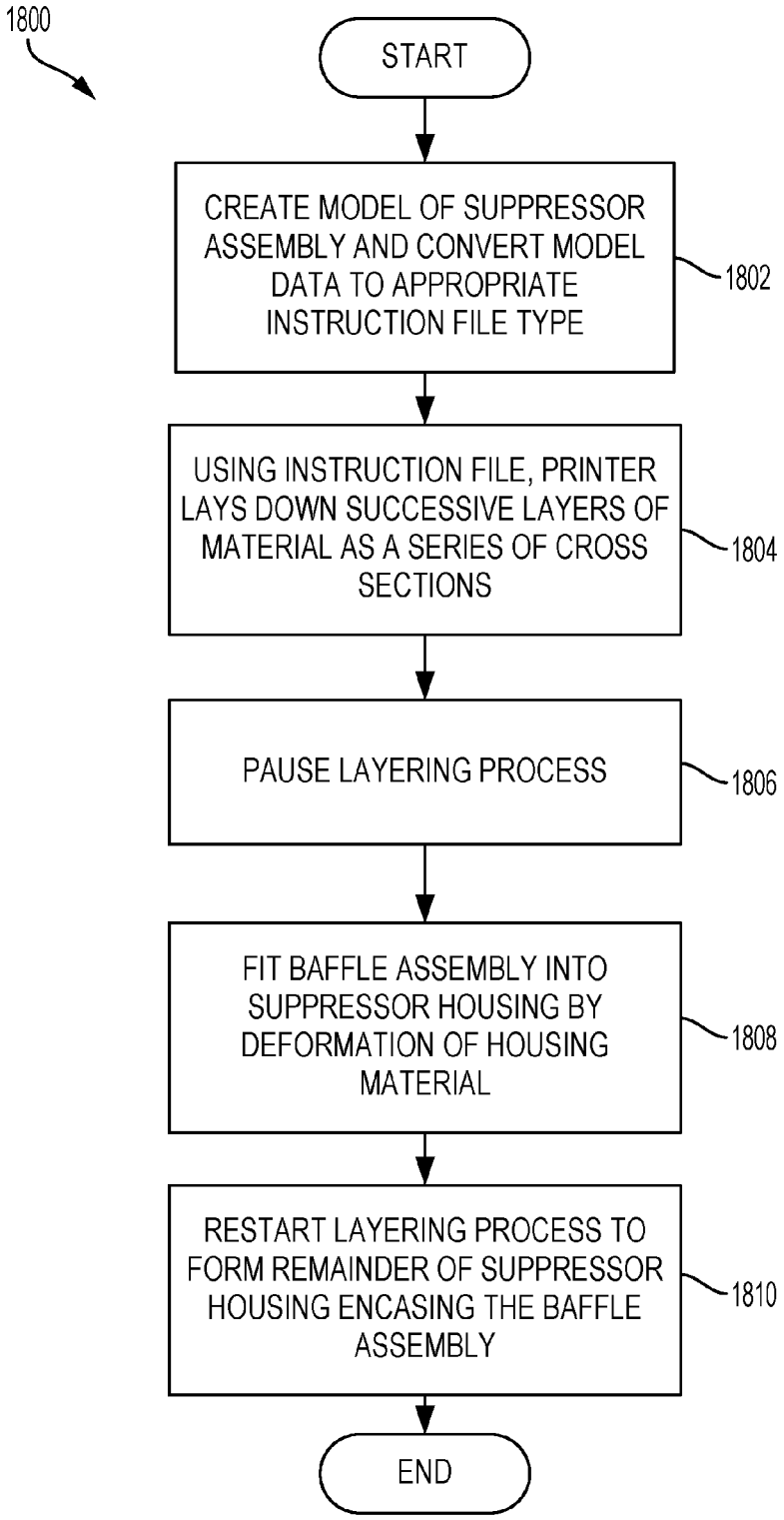
FIG. 18 is a flow diagram illustrating an example additive manufacturing process for constructing a firearm suppressor.

Finally, FIG. 18 provides an illustrative example of a method for manufacturing the disclosed suppressor. In some embodiments, specific areas of the firearm sound suppressor may require a complex geometry that may be difficult to manufacture as a single component. As such, employing only conventional processes to construct a firearm suppressor as disclosed herein may be inadequate. Thus, novel processes and operations of manufacturing may be preferentially executed. In some embodiments, methods utilizing additive processes, such as in 3-D printing, may be performed in order to form the described encasement of the baffle assembly in the housing body.

It will be appreciated that FIG. 18 is provided solely as an illustrative example of one method for producing one embodiment of the disclosed suppressor.

Method 1800 begins at block 1802 wherein a model of the suppressor is created and then the model data may be converted to an appropriate file type. In one example, a model of the suppressor may be drawn and converted into a corresponding CAD file that is readable by a 3-D printer. At block 1804, using an instruction file, a printer may lay down successive layers of material as a series of cross sections. For example, the 3-D printer may then follow instructions defined by the CAD file in order to lay down the successive layers of material, such as plastics and metals, in order to construct a model from the series of cross sections. These layers, which may correspond to the virtual cross sections from the CAD model, are joined or automatically fused during the additive manufacturing process. In some embodiments, the process may be paused or stopped at any point, such as in block 1806 for example. At block 1806, the layering process may be paused prior to completion of the full suppressor unit construction. At block 1808, a baffle section or multiple baffles may be fitted into the tubular housing by deformation of the housing material for example. Once the desired interior components such as the baffle assembly are fitted within the tubular housing, the 3-D printing process may then be resumed. It will be appreciated that this method may include creating groove or flange free projections and baffle sections so that the outer circumferential face of the baffle assembly may lie flush against an inner face of the projections of the tubular housing. At block 1810, the layering process may be restarted in order to form the remainder of the suppressor housing encasing the baffle(s). Method 1800 results in an encapsulated and unitary insert/housing component.

In another embodiment, the entirety of the suppressor may be manufactured in a single, uninterrupted 3-D printing process. In this way, the need to insert any interior components into the tubular housing may be avoided.

An example technical effect of utilizing the method described above is that the contiguous and uninterrupted encasement of the baffle assembly by the housing may allow the combined components to be substantially secured, durable, and immovable by the high energy gases of the discharged projectile. In an alternative embodiment, the suppressor and baffles may be made out of the same material such as Inconel, and may be printed using direct metal laser sintering (DMLS), in which case, a single unitary body, inclusive of the baffle assembly may be printed. In such an embodiment, there may be no need to pause the printing process in order to fit the baffle assembly into the housing. Instead, the printing process would continue uninterrupted, laying down material in such a way that there is no division between the housing and the baffle(s). The end product in this embodiment is a single unitary bonded suppressor made of a single material with no division (i.e., spaces between grooves/flanges) or additional adhesion (i.e., welds, bolts, threads, etc.) between the housing and the baffle(s) other than the internal strength of the material (such as Inconel) itself.

As such, additive processes appropriate and adequate for construction of the suppressor include, but are not limited to: selective laser melting (SLM) or direct metal laser sintering (DMLS), selective laser sintering (SLS), fused deposition modelling (FDM), stereolithography (SLA), and laminated object manufacturing (LOM).

From the above description, it can be understood that the energy suppressor and/or combination of the energy suppressor and firearm disclosed herein and the methods of making them have several advantages, such as: (1) they reduce the pressure (sound) of the report of the firearm with a minimal increase of the combined firearm and silencer length and weight; (2) they increase the life of the suppressor by reducing deterioration of the baffles from the exhaust components; (3) they improve accuracy and reduce the effect on vibration at the muzzle by way of reduced mass; (4) they aid in the dissipation of heat and reduce the tendency of the energy suppressor to overheat; and (5) they can be manufactured reliably and predictably with desirable characteristics in an economical manner.

Various advantages may be achieved, at least in some example implementations. For example, the structure described may provide inserts with heat resistant materials and/or with geometric designs that provide superior heat transfer, pressure reduction and vibration characteristics, while achieving both lightweight and high internal volume. Further, various features may enable the reduction of outlet pressure of discharge gases and resistance to structural stress.

An additional technical effect exhibited by one embodiment of the suppressor is the ability to rest flat on a flat surface when set on its side. This effect is achieved by the non-circular exterior shape of the tubular housing in some embodiments. In one example, the tubular housing may comprise a square, pentagonal, hexagonal, or any other non-circular shape such that at least one flat edge is provided.

It is further understood that the firearm sound suppressor described and illustrated herein represents only example embodiments. It is appreciated by those skilled in the art that various changes and additions can be made to such firearm sound suppressor without departing from the spirit and scope of this disclosure. For example, the firearm sound suppressor could be constructed from lightweight and durable materials not described. Moreover, the suppressor may further comprise of additional chambers not sequentially disposed along the longitudinal length of the housing, but rather along the lateral or radial axes of the housing. Also, although the firearm have been described herein to be fabricated as described in FIG. 18, another process or operation yielding a similar configuration of encapsulated inserts may be used.

As used herein, an element or step recited in the singular and then proceeded with the word "a" or "an" should be understood as not excluding the plural of said elements or steps, unless such exclusion is explicitly stated. Furthermore, references to "one embodiment" of the present subject matter are not intended to be interpreted as excluding the existence of additional embodiments that also incorporate the recited features. Moreover, unless explicitly stated to the contrary, embodiments, "comprising," "including," or "having" an element or a plurality of elements having a particular property may include additional such elements not having that property. The terms "including" and "in which" are used as the plain-language equivalents to the respective terms "comprising" and "wherein." Moreover, the terms "first," "second," and "third," etc. are used merely as labels, and are not intended to impose numerical requirements or a particular positional order on their objects.

This written description uses examples to disclose the invention, including best mode, and also to enable a person of ordinary skill in the relevant art to practice the invention, including making and using any devices or systems and performing any incorporated methods.

In one example aspect, the suppressor may include a unitary body defining an outer housing and internal baffles spaced away from an inner surface of the housing and not forming a joint with the inner surface of the housing, the baffles integral with the unitary body, the baffles being non-cylindrical but with a cross-section that follows a rifling pattern about a central axis along different axial positions of the central axis. The cross-section may be triangular or square, in some examples. Still other shapes may also be used. The outer housing may be non-circular.

The invention claimed is:

1. A sound suppressor, comprising:

a unitary single-piece body; and a baffle section positioned within the body and encapsulated by the body, the body and the baffle section forming one or more chambers, where the baffle section is triangular and helical in shape.

2. The sound suppressor of claim 1, wherein the unitary single-piece body includes helical sections extending towards a central axis of the unitary single-piece body.

3. The sound suppressor of claim 1, further comprising interior projections integral with the body at a longitudinally rearward portion of the sound suppressor.

4. The sound suppressor of claim 3, wherein a projectile entrance opening is at the longitudinally rearward portion of the sound suppressor, and wherein a projectile exit opening is at a longitudinally forward region of the sound suppressor.

5. The sound suppressor of claim 1, wherein the baffle section includes a u-shaped groove that axially surrounds a projectile path.

6. A sound suppressor, comprising:

a tubular housing, an interior of the tubular housing including helical sections that extend towards a central axis of the tubular housing; and a plurality of baffle sections positioned within the tubular housing and encapsulated by the tubular housing, the baffle sections triangular and helical in shape.

7. The sound suppressor of claim 6, wherein a helix of the triangular helical shape of the baffle sections rotates about an axis defined by a path of a projectile to be fired through the sound suppressor.

8. The sound suppressor of claim 6, wherein the plurality of baffle sections include a partially hollow interior section.

9. The sound suppressor of claim 8, wherein the partially hollow interior section contains small u-shaped passages along an axis defined by a path of a projectile to be fired through the sound suppressor.

10. The sound suppressor of claim 6, wherein the helical sections are integral with the tubular housing.

11. The sound suppressor of claim 10, wherein the tubular housing and the plurality of baffle sections are a single-piece.

12. The sound suppressor of claim 6, wherein the baffle sections are spaced along an interior of the tubular housing at constant distances.

13. The sound suppressor of claim 6, wherein a rearward end of the sound suppressor includes an opening for attaching the sound suppressor to a firearm barrel.

14. A firearm system, comprising:

a firearm including a barrel with a muzzle portion; and a suppressor coupled to the muzzle portion, the suppressor including a unitary single-piece body having a plurality of helical sections that extend towards a central axis of the body, and a plurality of baffle sections encapsulated and secured within the body without additional coupling elements between the interfacing surfaces of the baffle sections and an interior of the body, where the plurality of baffle sections are triangular and helical in shape.

15. The firearm system of claim 14, wherein the helical sections are fluted.

16. The firearm system of claim 14, wherein the body and the baffle sections form a plurality of expansion chambers.

17. The firearm system of claim 14, wherein the suppressor is coupled to the muzzle portion at a rearward end of the suppressor, and wherein a projectile entrance is at a rearward end of the suppressor.

18. The firearm system of claim 14, wherein a helix of the triangular helical shape of the baffle sections rotates about an axis defined by a path of a projectile to be fired through the sound suppressor.

19. The firearm system of claim 14, wherein the body includes a plurality of projections at a rearward region of the body, and wherein the plurality of projections are formed integrally with the body.

20. The firearm system of claim 14, wherein the plurality of baffle sections are connected to one another via junctions.

* * * * *